US007021213B2

(12) United States Patent
Sampei

(10) Patent No.: US 7,021,213 B2
(45) Date of Patent: Apr. 4, 2006

(54) PRINTING METHOD

(75) Inventor: Takeshi Sampei, Mitaka (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 71 days.

(21) Appl. No.: 10/884,981

(22) Filed: Jul. 6, 2004

(65) Prior Publication Data

US 2005/0011384 A1 Jan. 20, 2005

(30) Foreign Application Priority Data

Jul. 15, 2003 (JP) ..... 2003-197047

(51) Int. Cl.
*B41N 10/04* (2006.01)

(52) U.S. Cl. ..... 101/483; 101/375; 101/376; 430/27.1

(58) Field of Classification Search ..... 101/483, 101/375, 376; 430/271.1
See application file for complete search history.

(56) References Cited

U.S. PATENT DOCUMENTS 3,428,451 A * 2/1969 Trevoy ..... 430/63
5,154,120 A * 10/1992 Simeth ..... 101/375
6,209,455 B1 * 4/2001 Simeth ..... 101/382.1
6,484,634 B1 * 11/2002 Kasai et al. ..... 101/375
6,723,490 B1 * 4/2004 Patel et al. ..... 430/271.1
6,830,862 B1 * 12/2004 Kitson et al. ..... 430/156

FOREIGN PATENT DOCUMENTS

EP 0246012 * 11/1987
JP 03009357 A * 1/1991

* cited by examiner

*Primary Examiner*—Andrew H. Hirshfeld
*Assistant Examiner*—Andrea H. Evans
(74) *Attorney, Agent, or Firm*—Lucas & Mercanti LLP

(57) ABSTRACT

Disclosed is a printing method comprising the steps of mounting an underlay sheet on a plate cylinder of a printing press, and providing, on the underlay sheet, a printing plate material comprising a plastic sheet support, and provided thereon, a hydrophilic layer, an image formation layer and a backing layer, the backing layer being provided on the side of the support opposite the image formation layer, so that the backing layer side surface of the printing plate material contacts the underlay sheet surface, wherein a coefficient of dynamic friction of the backing layer side surface of the printing plate material to the underlay sheet surface is from 0.1 to 0.5.

12 Claims, 1 Drawing Sheet

PRINTING METHOD

FIELD OF THE INVENTION

The present invention relates to a printing method comprising the steps of mounting, on a plate cylinder of a printing press, a printing plate material comprising a plastic sheet support, and provided thereon, a hydrophilic layer, an image formation layer and a backing layer, so that the printing plate material is provided between an underlay sheet and the plate cylinder.

BACKGROUND OF THE INVENTION

As a support for a printing plate material, a plate of metals such as aluminum has been used. In recent years, a printing plate material employing a plastic sheet support such as a polyester film sheet has been developed in that it is easy to handle or carry (see for example, Japanese Patent O.P.I. Publication Nos. 5-257287, 2000-258899 and 2002-79773).

However, the printing plate employing the plastic sheet support has problem in that when it is mounted on a plate cylinder of a printing press, distortion due to its elongation occurs. As a method to solve this problem, a method is known which intervenes an underlay sheet between the printing plate material and the plate cylinder (see for example, Japanese Patent O.P.I. Publication No. 10-193828).

However, these techniques have still problem that during printing, a printing plate moves on a plate cylinder of a printing press, resulting in variation of length of printed matter, i.e., printing position stability deteriorates. Further, they have another problem that printing properties such as initial ink receptivity and printing durability are greatly lowered. Particularly, this problem is likely to occur after long length storage of the printing plate.

SUMMARY OF THE INVENTION

An object of the invention is to provide a printing method, employing a printing plate material comprising a plastic sheet support, which provides improved printing position stability, initial ink receptivity and printing durability.

DETAILED DESCRIPTION OF THE INVENTION

Figure 1:
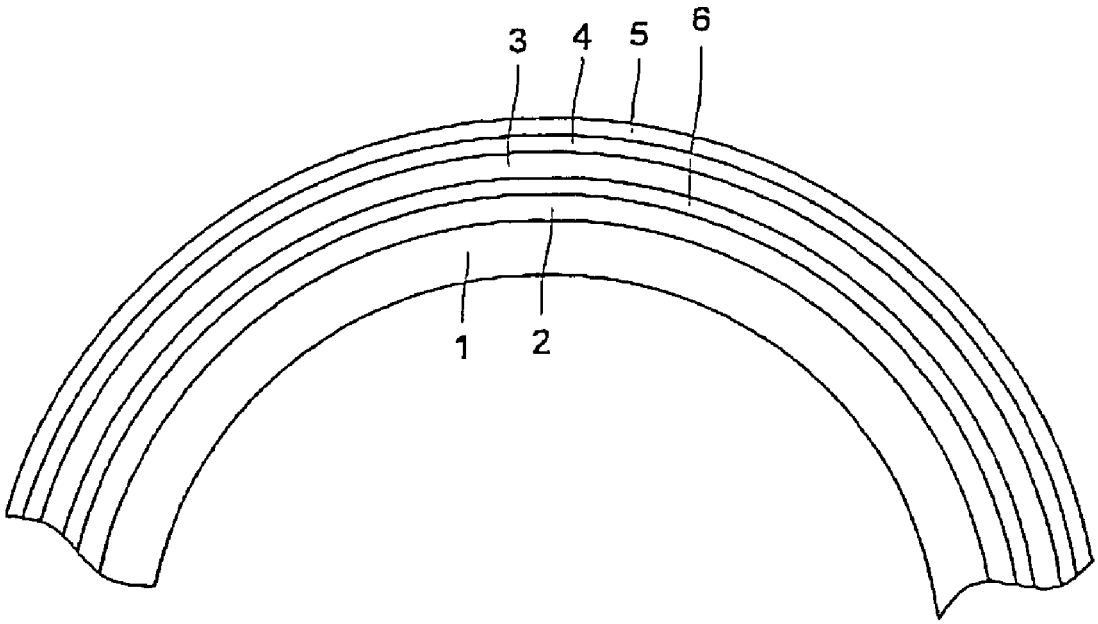
FIG. 1 is a sectional view showing a printing plate material and a plate cylinder of a printing press according to the present invention, in which on the plate cylinder 1 are provided an underlay sheet 2 and a printing plate comprising a plastic sheet support 3, a hydrophilic layer 4, an image formation layer 5 and a backing layer 6.

The above object has been attained by one of the following constitutions:

1. A printing method comprising the steps of mounting an underlay sheet on a plate cylinder of a printing press, and providing, on the underlay sheet, a printing plate material comprising a plastic sheet support, and provided thereon, a hydrophilic layer, an image formation layer and a backing layer, the backing layer being provided on the side of the support opposite the image formation layer, so that the backing layer side surface of the printing plate material contacts the underlay sheet surface, wherein a coefficient of dynamic friction of the backing layer side surface of the printing plate material to the underlay sheet surface is from 0.1 to 0.5.

2. The printing method of item 1 above, wherein the coefficient of dynamic friction of the backing layer side surface of the printing plate material to the underlay sheet surface is from 0.1 to 0.45.

3. The printing method of item 1 above, wherein a specific resistance at 23° C. and 20% RH of the backing layer side surface of the printing plate material is from $1\times10^{11}$ to $2\times10^{13}$ Ω.

4. The printing method of item 1 above, wherein the plastic sheet support of the printing plate material is a polyester film sheet having an average thickness of from 120 to 300 μm, and having a thickness distribution of not more than 10%.

5. The printing method of item 1 above, wherein the image formation layer contains heat melting particles or heat fusible particles.

6. The printing method of item 1 above, wherein the underlay sheet comprises a substrate and provided thereon, a surface layer containing particles with an average particle diameter of from 0.1 to 15 μm.

7. The printing method of item 1 above, wherein the backing layer side has a surface with a smoother value of from 5 to 120 kPa and the underlay sheet has a surface with a smoother value of from 0.2 to 20 kPa.

8. The printing method of item 1 above, wherein an electrically conductive layer containing an electrically conductive material is provided on the backing layer side of the printing plate material.

1—1. A printing method comprising the steps of mounting, on a plate cylinder of a printing press, a printing plate material comprising a plastic sheet support, and provided thereon, a hydrophilic layer, an image formation layer and a backing layer, so that an underlay sheet is provided between the printing plate material and the plate cylinder, wherein a coefficient of dynamic friction of the backing layer side surface of the printing plate material to the underlay sheet surface is from 0.1 to 0.5.

1-2. An underlay sheet which is used in the printing method of item 1—1 above.

1-3. A printing plate material mounting method comprising the step of mounting, on a plate cylinder of a printing press, a printing plate material comprising a plastic sheet support, and provided thereon, a hydrophilic layer, an image formation layer and a backing layer, so that an underlay sheet is provided between the printing plate material and the plate cylinder, wherein a specific resistance at 23° C. and 20% RH of the backing layer side surface of the printing plate material is from $1\times10^{11}$ to $2\times10^{13}$ Ω, and a coefficient of dynamic friction of the backing layer side surface of the printing plate material to the underlay sheet surface is from 0.1 to 0.5.

1-4. The printing plate material mounting method of item 1-3 above, wherein the plastic sheet support of the printing plate material is a polyester film sheet having an average thickness of from 120 to 300 μm, and having a thickness distribution of not more than 10%.

1-5. The printing plate material mounting method of item 1-3 or 1-4 above, wherein the image formation layer contains heat melting particles and heat fusible particles.

The present invention will be detailed below.

The present invention is characterized in that in a printing method mounting, on a plate cylinder of a printing press, a printing plate material comprising a plastic sheet support, and provided thereon, a hydrophilic layer, an image formation layer and a backing layer, so that an underlay sheet is provided between the printing plate material and the plate cylinder, a coefficient of dynamic friction of the backing layer side surface of the printing plate material to the underlay sheet surface is from 0.1 to 0.5.

The present invention is characterized in an underlay sheet which is used in the printing method described above.

Further, the present invention is characterized in that in a printing plate material mounting method comprising the step of mounting, on a plate cylinder of a printing press, a printing plate material comprising a plastic sheet support, and provided thereon, a hydrophilic layer, an image formation layer and a backing layer, so that an underlay sheet is provided between the printing plate material and the plate cylinder, a specific resistance at 23° C. and 20% RH of the backing layer side surface of the printing plate material is from $1\times10^{11}$ to $2\times10^{13}$ Ω, and a coefficient of dynamic friction of the backing layer side surface of the printing plate material to the underlay sheet surface is from 0.1 to 0.5.

In the invention, a surface on the backing layer side (rear surface) of the printing plate material has a coefficient of dynamic friction to a surface of an underlay sheet being from 0.1 to 0.5, and preferably from 0.1 to 0.4, the underlay sheet being provided between the printing plate material and a plate cylinder of a printing press. The coefficient of dynamic friction in the invention is one determined according to a method according to JIS K7125.

The coefficient of dynamic friction is determined employing for example, DF-PM APPARATUS produced by Kyowa Kaimen Kagaku Co., Ltd. or a desk-top universal tester AGS-100B produced by Shimazu Seisakusho Co., Ltd., in which when a load of a 50 g stainless steel piece is put on the backing layer side surface to be brought into contact with the underlay sheet surface at a contact area of 100 mm×100 mm and the load is pulled in the horizontal direction by application of force to move at a speed of 100 mm/minute, the average force (F) is measured, and the coefficient (μ) of dynamic friction is defined by the following formula:

$$\text{Coefficient of dynamic friction} = F(g)/\text{Weight } (g) \text{ of load}$$

In the invention, the surface on the backing layer side of the printing plate material has a specific resistance of from $1\times10^{11}$ to $2\times10^{13}$ Ω, after the printing plate material has been stored at 23° C. and 20% RH for 24 hours. Herein, the specific resistance, immediately after the printing plate material has been stored at 23° C. and 20% RH for 24 hours, is determined under the same ambience as above, i.e., at 23° C. and 20% RH, employing a specific resistance meter, for example, an insulation resistance meter, Teraohm Meter Model VE-30 produced by Kawaguchi Denki Co., Ltd.

In the invention, the printing plate material whose surface on the backing layer side has a specific resistance and/or a coefficient of dynamic friction each falling within the range as defined above can be prepared employing an appropriate combination of the following methods 1, 2 and 3.

1: An electrically conductive layer is provided between the support and the image formation layer, or on the backing layer side of the printing plate material.
2: The surface on the backing layer side has a smoother value of from 5 to 120 kPa.
3: The surface of the underlay sheet has a smoother value of from 0.2 to 20 kPa.

The methods 1 through 3 above will be explained below.

<1. An Electrically Conductive Layer is Provided between the Support and the Image Formation Layer, or on the Backing Layer Side of the Printing Plate Material>

The printing plate material in the invention preferably has an electrically conductive layer between the support and the image formation layer, or on the backing layer side. Examples of the electrically conductive layer in the invention include a layer containing a water-soluble salt (such as a chloride or nitrate), a vapor-deposited metal layer, water-insoluble inorganic salts described in U.S. Pat. No. 3,428,451, electrically conductive metal oxides described later, or electrically conductive materials such as electrically conductive polymers including ionic polymers described in U.S. Pat. Nos. 2,861,056 and 3,206,312. Of these, a layer containing the electrically conductive metal oxides or the electrically conductive polymers is preferred. Preferred electrically conductive materials are metal oxides as shown below.

The electrically conductive materials in the invention include electrically conductive polymers, metal oxides, and electrically conductive carbon black.

The electrically conductive polymer in the invention is preferably a water-soluble electrically conductive polymer, and it has an antistatic function in combination with hydrophobic polymer particles and a hardening agent. As the water-soluble electrically conductive polymer, there is a polymer having at least one electrically conductive group selected from a sulfonic acid group, a sulfuric acid ester group, a quaternary ammonium group, and a carboxyl group, wherein the polymer has not more than 5% by weight per one polymer molecule. The water-soluble electrically conductive polymer may have a hydroxyl group, an amino group, an aziridine group, an active methylene group, a sulfinic acid group, an aldehyde group, or a vinyl sulfone group. The water-soluble electrically conductive polymer has a molecular weight of preferably from 3,000 to 100,000, and more preferably from 3,500 to 70,000. Examples of the water-soluble electrically conductive polymer include a polymer as disclosed in for example, items [0033] to [0046] of Japanese Patent O.P.I. Publication No. 7-20596.

The electrically conductive polymer can be synthesized by polymerizing a monomer prepared according to a conventional method or a monomer available on the market. The content of the electrically conductive polymer is preferably from 0.01 to 10 g/m$^2$, and more preferably from 0.1 to 5 g/m$^2$. The electrically conductive polymer can form a layer singly or in combination with other hydrophilic binders or hydrophobic binders. As the hydrophilic binders, gelatin, polyacrylamide, colloidal albumin, cellulose acetate, cellulose nitrate, polyvinyl alcohol, hydrolyzed polyvinyl acetate, or phthalated gelatin is advantageously used. As hydrophilic binders, there are a polymer having a molecular weight of 20,000 to 1000,000, styrene-butyl acrylate-acrylic acid copolymer, butyl acrylate-acrylonitrile-acrylic acid copolymer, and methyl methacrylate-ethyl acrylate-acrylic acid copolymer.

The hydrophobic polymer particles used in the electrically conductive layer are latex particles which are insoluble in water. The hydrophobic polymers are not specifically limited, but include polymers obtained by polymerizing a monomer selected from styrene, styrene derivative, alkyl acrylate, alkyl methacrylate, olefin derivative, halogenated ethylene, vinyl ester, and acrylonitrile. The hydrophilic polymer is preferably a polymer having styrene, alkyl acrylate, alkyl methacrylate in an amount of preferably not less than 30 mol %, and more preferably not less than 50 mol %.

As methods to obtain latex of the hydrophobic polymer, there are two methods, an emulsion polymerization method and a dispersion method, in which the polymer is dissolved in a low boiling point solvent, followed by evaporation of the solvent, but the emulsion polymerization method is preferred in obtaining fine particles with a uniform particle size. The molecular weight of the hydrophobic polymer is preferably not less than 3,000, and there is no difference in transparency due to molecular weight.

Examples of the hydrophobic polymer include a polymer as disclosed in for example, items [0052] to [0057] of Japanese Patent O.P.I. Publication No. 7-20596. The content of the hydrophobic polymer is preferably from 0.01 to 10 $g/m^2$, and more preferably from 0.1 to 5 $g/m^2$.

In the above emulsion polymerization, a surfactant can be used, and in the dispersion method, a dispersant can be used. As the dispersant, a non-ionic surfactant is used, and typically, a polyalkylene oxide is preferably used. The polyalkylene oxide is a compound having a polyalkylene oxide-chain segment of from 3 to 500. The polyalkylene oxide can be synthesized by condensation of polyalkylene oxide with a compound having active hydrogen such as aliphatic alcohol, phenols, fatty acid, aliphatic mercaptan, or organic amines, or by condensation of polyols such as polypropylene glycol or polyoxytetramethylene with aliphatic mercaptan, organic amines, ethylene oxide or propylene oxide.

The polyalkylene oxide may be a polymer consisting of one kind of polyalkylene oxide-chain segments, or a block copolymer in which two or more kinds of polyalkylene-chain segments are combined through another chain segment in the copolymer molecule. A degree of polymerization of the polyalkylene oxide in the block copolymer is preferably from 3 to 100 in total. Examples of the polyalkylene oxide used in the invention include those disclosed in Japanese Patent O.P.I. Publication No. 3-265842.

The hardener used in the electrically conductive layer is preferably a hydroxyl-containing epoxy hardener, and is more preferably a reaction product [CA] of polyglycidol with epihalohydrin. This product is considered to be a mixture in view of its synthetic method, however, it is not important whether or not it is a mixture, since the effect of the invention can be obtained by controlling the number of a hydroxyl group or an epoxy group in the product. The product may be a mixture or a compound. Examples of the product include those disclosed in paragraphs [0062] to [0073] of Japanese Patent O.P.I. Publication No. 7-20596.

Next, a metal oxide as the electrically conductive material will be explained. Crystalline metal oxide particles are preferred as metal oxide. Metal oxides containing oxygen defects or metal oxides as donors containing a small amount of a hetero atom are preferred, since they generally have high electroconductivity. The latter metal oxides as donors containing a small amount of a hetero atom are especially preferred, since they do not vary performance.

The metal oxides are preferably $ZnO_2$, $TiO_2$, $SnO_2$, $Al_2O_3$, $In_2O_3$, $SiO_2$, MgO, BaO, $MoO_3$, $V_2O_5$, and composite metal oxides thereof, and more preferably $ZnO_2$, $TiO_2$, and $SnO_2$. As the metal oxides containing a hetero atom, $SnO_2$ doped with Sb or $TiO_2$ doped with Nb or Ta is effective. The doping amount of the hetero atom is preferably from 0.01 to 30 mol %, and more preferably from 0.1 to 10 mol %.

The metal oxide particles used in the invention are electrically conductive, and have a volume resistivity of preferably not more than $10^7$ Ωcm, and more preferably not more than $10^5$ Ωcm. Examples of the metal oxide include those disclosed in Japanese Patent O.P.I. Publication Nos. 56-143431, 56-120519, and 58-62647. The metal oxide particles are used in the form dispersed or dissolved in a binder. The binder used is not specifically limited, as long as it can form a film. The content by volume of the metal oxide in the electrically conductive layer is preferably higher in order to reduce a specific resistance of the electrically conductive layer employing the metal oxides, and the content of the metal oxide in the electrically conductive layer is not less than 5% by weight in obtaining an electrically conductive layer with sufficient strength. Therefore, the content by volume of the metal oxide in the electrically conductive layer is preferably from 5 to 95%. The added amount of the metal oxide in the electrically conductive layer is preferably from 0.05 to 10 $g/m^2$, and more preferably from 0.08 to 5 $g/m^2$. The added amount above provides an intended anti-static property.

As the electrically conductive carbon black, there are acetylene black, which is obtained according to a continuous cracking method which introduces an acetylene gas into a heated reaction furnace to cause cracking and elevate the furnace temperature, whereby cracking automatically proceeds; lamp black, or soot obtained due to incomplete combustion of oil, tar or resins by indirect flame; another electrically conductive carbon black such as high structure furnace black; and a mixture thereof. The particle size of the carbon black is preferably not more than 100 μm, and more preferably from 0.01 to 2 μm. The carbon black of not less than 100 μm contaminates the coated layer, and cannot be sufficiently dispersed, so that a layer, in which the carbon black is uniformly dispersed, is not obtained. This loses commercial value. The electrically conductive carbon black in the invention is black, and also has an anti-halation property. The content of the electrically conductive carbon black is preferably from 0.01 to 10 $g/m^2$, and more preferably from 0.1 to 5 $g/m^2$.

In the invention, the electrically conductive layer containing the electrically conductive material is preferably provided between the support and the image formation layer or on the backing layer side, and more preferably on the backing layer side. Provision of the electrically conductive layer improves an electrostatic property, and decreases dust deposition, greatly reducing white spot faults during printing.

<2. A Backing Layer Side Surface has a Smoother Value of from 5 to 120 kPa>

The smoother value in the invention is a physical value described in the J. TAPPI paper pulp test No. 5, and is a barometer of unevenness or mattedness of the surface. The smoother value is defined as a pressure value (kPa) obtained by being measured according to the following conditions. Measurement is carried out employing a smoother SM-6B produced by Toei Denki Kogyo Co., Ltd. This device employing a vacuum type air micrometer measures a pressure of air introduced into the measuring head adsorbed onto a surface to be measured according to unevenness of the surface. A greater smoother value implies that the surface is rougher. When air in the measuring head, which is put on the surface to be measured, is evacuated through an aperture having a certain area by vacuum pump, air pressure P (kPa) in the head is measured as a smoother value. The printing plate material before measurement is subjected to conditioning at 23° C. and at 60% RH (relative humidity) for 2 hours, and the smoother value is measured under the same conditions.

In the invention, the backing layer is at least one structural layer provided on the surface of the support opposite the image formation layer. A preferred structural layer is a subbing layer, a hydrophilic binder-containing layer, or a hydrophobic binder-containing layer. The binder-containing layer may be provided on the subbing layer.

The hydrophilic binder may be any as long as it exhibits hydrophilicity, and examples of the hydrophilic binder include resins having, as a hydrophilic group, a hydroxyl group such as polyvinyl alcohol (PVA), cellulose resins (methylcellulose MC, ethylcellulose EC, hydroxyethylcellulose HEC, carboxymethylcellulose CMC), chitins, or starch; resins having an ether bond such as polyethylene oxide PEO, polypropylene oxide PPO, polyethylene glycol PEG, or polyvinyl ether PVE; resins having an amide group or an amide bond such as polyacryl amide PAAM or polyvinyl pyrrolidone PVP; resins having as a dissociation group a carboxyl group such as polyacrylic acid salts, maleic acid resins, alginates or gelatins; polystyrene sulfonic acid salt; resins having an amino group, an imino group, a tertiary amino group or a quaternary ammonium group such as polyallylamine PAA, polyethylene imine PEI, epoxidated polyamide EPAM, polyvinyl pyridine or gelatins.

The hydrophobic binder may be any as long as it exhibits hydrophobicity, and examples of the hydrophobic binder include polymers derived from α,β-ethylenically unsaturated monomers such as polyvinyl chloride, chlorinated polyvinyl chloride, a copolymer of vinyl chloride and vinylidene chloride, a copolymer of vinyl chloride, and vinyl acetate, polyvinyl acetate, partially saponified polyvinyl acetate, polyvinyl acetal or preferably polyvinyl butyral in which a part of polyvinyl alcohol is acetalized with aldehyde, a copolymer of acrylonitrile and acryl amide, polyacrylates, polymethacrylates, polystyrene, polyethylene and a mixture thereof. The hydrophobic binder may be water dispersible resins disclosed in Japanese Patent O.P.I. Publication No. 2002-258469, sections [0033] through [0038], as long as it can make the surface of the printing plate material hydrophobic.

A laser recording device or a processless printing press has a sensor for controlling transport of a printing plate material in it. In order to perform the controlling successfully, the printing plate material preferably comprises a component layer containing a dye or pigment. The dye or pigment used in the component layer is preferably an infrared dye or pigment used as the light-to-heat conversion material described above. Further, the component layer can contain a conventional surfactant.

A backing layer side surface with a smoother value of from 5 to 120 kPa can be obtained according to a combination of the following methods.

(a) At least one layer on the backing layer side contains inorganic or organic matting agent having an average particle diameter of from 0.5 to 40 μm.

(b) A coating solution for a layer on the backing layer side is coated on a support, dried at not more than 30° C. for not less than 10 seconds, and then wound around a take-up spool to be in roll form.

It is preferred that in the invention, at least one layer on the backing layer side contains inorganic or organic matting agent having an average particle diameter of from 0.5 to 40 μm. It is especially preferred that the inorganic or organic matting agent is contained in an outermost layer on the backing layer side.

Examples of the inorganic matting agent include silicon dioxide, titanium dioxide, magnesium dioxide, aluminum oxide, barium sulfate, calcium carbonate, silver chloride or bromide desensitized according to the known method, glass, and diatomaceous earth. Silicon dioxide, titanium dioxide, and aluminum oxide are preferred. These may be used as a mixture of two or more thereof or in combination with the organic matting agent described later. These matting agents can be obtained according to the method disclosed in U.S. Pat. Nos. 1,260,772, 2,192,241, 3,257,260, 3,370,951, 3,523,022, and 3,769,020.

The inorganic matting agent has an average particle size of preferably from 0.5 to 35 μm, more preferably from 0.7 to 30 μm, and still more preferably from 1 to 25 μm. In the invention, the average particle size of the matting agent can be obtained by calculating the diameter of a circle corresponding to the projected area in the electron microscope photograph of the matting agent. The content of the inorganic matting agent in the inorganic matting agent-containing layer is preferably from 0.01 to 1 g/m$^2$, and more preferably from 0.05 to 0.5 g/m$^2$.

The organic matting agent used in the invention is preferably an organic polymer matting agent consisting of an organic polymer. Examples of the organic polymer include acryl resin, vinyl chloride resin, vinyl acetate resin, styrene resin, vinylidene chloride resin, acetal resin, and cellulose resin. These resins are preferably used in the form dispersed as particles with an average particle size of 0.5 to 40 μm, and preferably 0.7 to 35 μm in water or in a water-soluble polymer such as gelatin or polyacrylamide.

Examples of a polymer used the organic matting agent will be listed below, but the invention is not limited thereto.

(1) Acryl resin: polymethyl methacrylate, polyethyl methacrylate, polypropyl methacrylate, polydimethylaminoethyl methacrylate, polymethyl acrylate, polyethyl acrylate, polymethoxyethyl acrylate, etc.

(2) Acryl copolymer resin: copolymers of the monomers described in item (1) above with vinyl chloride, vinylidene chloride, vinylpyridine, styrene, acrylonitrile, acrylic acid, or methacrylic acid, etc.

(3) Vinyl chloride resin: polyvinyl chloride, copolymer of vinyl chloride with vinyl acetate, vinylidene chloride, acrylic acid, methacrylic acid, maleic acid, maleic ester, or acrylonitrile, etc.

(4) Polyvinyl acetate or its partially saponified resin (5) Styrene resin: Polystyrene, copolymer of styrene with acrylonitrile, etc.

(6) Vinylidene chloride resin: polyvinylidene chloride, copolymer of vinylidene chloride with acrylonitrile, etc.

(7) Acetal resin: polyvinyl formal, polyvinyl butyral, etc.

(8) Cellulose: cellulose acetate, cellulose propionate, cellulose butyrate, cellulose nitrate, etc.

(9) Melamine resin: melamine-formaldehyde resin, benzoguanamie-melamine-formaldehyde resin, etc.

A dispersion of these organic matting agents can be obtained according to a method in which the polymers are dissolved in an organic solvent and mixed in water or an aqueous gelatin solution with vigorous stirring, a method in which the polymer is precipitated in form of particles during emulsion polymerization, precipitation polymerization, or pearl polymerization of monomers, or a method in which the matting agent particles are dispersed in water or an aqueous gelatin solution employing a stirrer, a homogenizer, a colloid mill, a flow jet mixer or an ultrasonic dispersion device.

The organic matting agent has an average particle size of preferably from 0.5 to 40 μm, more preferably from 0.7 to 35 μm, and still more preferably from 1 to 30 μm. In the invention, the average particle size of the organic matting agent can be obtained by calculating the diameter of a circle corresponding to the projected area in the electron microscope photograph of the matting agent. The content of the organic matting agent in the organic matting agent-containing layer is preferably from 0.01 to 1 g/m$^2$, and more preferably from 0.05 to 0.5 g/m$^2$.

(b) It is preferred in the invention that a coating solution for a layer on the backing layer side is coated on a support, and dried at not less than 30° C. for not less than 10 seconds, and the resulting material is wound around a take-up spool to be in roll form.

A printing plate material comprising an image formation layer is preferably prepared according to a process in which each component layer solution is coated on a support employing a dip coating method, a air-knife coating method, a curtain coating method, or an extrusion coating method (these coating methods are detailed in Hara Yuji, Coating Technology, Showa 46, published by Asakura Shoten), and dried at not less than 30° C. for not less than 10 seconds, and the resulting material is wound around a take-up spool to be in roll form. The printing plate material in roll form is cut into an intended size, and packed in a packaging material described later.

<3. Underlay Sheet Having a Surface with a Smoother Value of 0.2 to 20 kPa>

The underlay sheet of the invention will be explained below. The surface of the underlay sheet refers to a surface of the underlay sheet contacting the backing layer side surface of a printing plate material.

As a substrate for the underlay sheet, metal plates, resin sheets or metal-resin composite sheets are used. The substrate is preferably a metal plate such as an aluminum plate, a zinc plate, a titanium plate, or a stainless steel plate; a bimetal plate such as a copper-aluminum plate, a copper-stainless steel plate, or a chromium-copper plate; a trimetal plate such as a chromium-copper-aluminum plate; a chromium-lead-iron plate, or chromium-copper-stainless steel plate; a resin sheet such as a PET sheet, a PE sheet, a PP sheet, a polyester sheet, a polyimide sheet, a polyamide sheet, or an acryl resin sheet; or a metal-resin composite sheet such as an aluminum-PET sheet, an aluminum-PE sheet, an aluminum-polyester sheet, a titanium-PET sheet or a titanium-polyester sheet, and more preferably a metal plate such as an aluminum plate or a stainless steel plate; a resin sheet such as a PET sheet or a PE sheet; or a metal-resin composite sheet such as an aluminum-PET sheet or an aluminum-polyester sheet.

The substrate is preferably a sheet having an initial modulus of not less than 350 kgf/mm$^2$. This sheet makes an underlay sheet efficiently function, since the surface of the underlay sheet is not dented by printing pressure. The thickness of the substrate is preferably from 50 to 250 μm. Measurement of initial modulus can be carried out according to JIS K7127.

An underlay sheet having a surface with a smoother value of from 0.2 to 20 kPa can be obtained according to a combination of the following methods.

(a) an underlay sheet having a surface layer containing particles with an average particle diameter of from 0.1 to 15 μm, (b) The underlay sheet is obtained by coating a dispersion in which the above particles are dispersed in a binder resin on an appropriate sheet, or by forming a binder resin layer on an appropriate sheet and then depositing the particles onto the resin binder layer.

The average particle diameter of particles used is preferably from 0.1 to 15 μm, more preferably from 0.1 to 13 μm, and still more preferably from 0.1 to 12 μm. Materials of particles are not specifically limited, and particles of inorganic materials, organic materials, or organic-inorganic composite materials are used. The particles are preferably used which have a hardness higher that that of the backing layer side surface of a printing plate material.

The organic materials for organic particles include metals, metal oxides, metal nitrides, metal hydroxides, metal sulfides, metal carbides and composites thereof, and are preferably glass, oxides such as $SiO_2$, $TiO_2$, ZnO, $Fe_2O_3$, $ZrO_2$ or $SnO_2$ or sulfides such as ZnS or CuS.

The organic particles are particles of synthetic resins or natural resins, and preferably particles of synthetic resins such as acryl resin, polyethylene, polypropylene, polyethylene oxide, polypropylene oxide, polyethylene imine, polystyrene, polyurethane, polyurea, polyester, polyamide, polyimide, carboxymethylcellulose, gelatin, starch, chitin, and chitosan, and more preferably particles of acryl resin, polyethylene, polypropylene, or polystyrene.

Materials for organic-inorganic composite particles include composites comprising at least two of materials for the above inorganic particles and organic particles, and are preferably composites of glass, oxides such as $SiO_2$, $TiO_2$, ZnO, $Fe_2O_3$, $ZrO_2$ or $SnO_2$ and/or sulfides such as ZnS or CuS; and acryl resin, polyethylene, polypropylene, polyethylene oxide, polypropylene oxide, polyethylene imine, polystyrene, polyurethane, polyurea, polyester, polyamide, polyimide, carboxymethylcellulose, gelatin, starch, chitin, and chitosan, and more preferably composites of oxides such as $SiO_2$, $TiO_2$, ZnO, $Fe_2O_3$, $ZrO_2$ or $SnO_2$; and acryl resin having a functional group capable of forming hydrogen bonding, polyethylene oxide, polypropylene oxide, polyethylene imine, polyurethane, polyurea, polyester, polyamide, polyimide., carboxymethylcellulose, gelatin, starch, chitin, or chitosan.

In the invention, as a binder resin for dispersing or binding such particles, a natural resin, a semi-synthetic resin or a synthetic resin such as an organic resin (oleophilic resin or water-soluble resin), an organic resin emulsion, an inorganic resin, or an organic-inorganic hybrid resin can be used, and is optionally cured.

Examples of the oleophilic resin include acryl resin (polymethyl methacrylate, polymethyl acrylate, polyethyl methacrylate, alkyl, aralkyl or aryl acrylate copolymer, alkyl, aralkyl or aryl methacrylate copolymer, etc.); alkyd resin (melamine resin, phenol resin, etc.); polystyrene resin; polyvinyl acetate resin; epoxy resin, polyalkylene resin (polyethylene, polypropylene, etc.); polyester resin; and polyurethane resin.

Examples of the water-soluble resin include cellulose; cellulose derivatives (cellulose esters such as cellulose nitrate, cellulose sulfate, cellulose acetate, cellulose propionate, cellulose succinate, cellulose butyrate, cellulose succinate acetate, cellulose acetate butyrate, and cellulose acetate phthalate, cellulose ethers such as methylcellulose, ethylcellulose, cyanoethylcellulose, carboxymethylcellulose, hydroxyethylcellulose, hydroxypropylcellulose, ethylhydroxyethylcellulose, hydroxypropylmethylcellulose, and carboxmethylhydroxyethylcellulose); starch; starch derivatives (oxidized starch, esterified starch such as starch esterified with nitric acid, sulfuric acid, phosphoric acid, acetic acid, propionic acid, butyric acid, or succinic acid; etherified starch such as methyl, ethyl, cyanoethyl, hydroxyalkyl or carboxymethyl ether of starch); alginic acid; pectin; carrageenan; gum tamarind; natural gums (gum arabic, guar gum, locust been gum, gum tragacanth, or xanthan gum); pullulan; dextran; dextran; casein; gelatin; chitin; chitosan; polyvinyl alcohol; polyalkylene glycol (polyethylene glycol, polypropylene glycol, ethylene-propylene glycol copolymer); allylalcohol copolymer; acrylic acid copolymer; methacrylic acid copolymer; polyamino acid; polyamide (homopolymer or copolymer of N-substituted acrylamide or methacrylamide, the N-substituent being methyl, ethyl, propyl, isopropyl, butyl, phenyl, monomethylol, 2-hydroxyethyl, 3-hydroxypropyl, 1,1-bis (hydroxymethyl)ethyl, or 2,3,4,5,6-pentahydroxypentyl); polyamine (polyethyleneamine, polyallylamine, polyvinyl amine); and polyurea (urea resin).

Examples of the organic resin emulsion include acryl resin (polymethyl methacrylate, polymethyl acrylate, polyethyl methacrylate, alkyl, aralkyl or aryl acrylate copolymer, alkyl, aralkyl or aryl methacrylate copolymer, etc.) emulsion; alkyd resin (melamine resin, phenol resin, etc.) emulsion; styrene resin emulsion; vinyl acetate resin emulsion; epoxy resin emulsion; alkylene (polyethylene, polypropylene, etc.) resin emulsion; ester resin emulsion; and urethane resin emulsion.

Examples of the inorganic resin include resins (hereinafter also referred to as metal-containing resins) containing a chain in which a metal atom is linked to an oxygen atom or a nitrogen atom. The metal-containing resins refer to polymers which mainly contain a bond of oxygen atom (nitrogen atom)-metal atom-nitrogen atom (oxygen atom).

Among the metal-containing resins, containing a bond of oxygen atom-metal atom-nitrogen atom, a polymer obtained by hydrolytic polycondensation of a metal compound represented by the following formula (I) is preferred. Hydrolytic polycondensation herein referred to implies a reaction in which a compound having a reactive group is hydrolyzed under acidic or basic condition, whereby repeated condensation reaction is repeated and polymerization proceeds.

$$(R_0)nM(Y)x-n \qquad \text{Formula (I)}$$

In Formula (I), $R_0$ represents a hydrogen atom, a hydrocarbon group or a heterocyclic group; Y represents a reactive group; M represents a trivalent to hexavalent metal; x represents a valence of the metal M; and n represents 0, 1, 2, 3, or 4, provided that (x−n) is an integer of 2 or more.

Next, the metal compound represented by formula (I) will be detailed.

$R_0$ preferably represents a substituted or unsubstituted, straight-chained or branched alkyl group having a carbon atom number of from 1 to 12 (for example, a methyl group, an ethyl group, a propyl group, a butyl group, a pentyl group, a hexyl group, a heptyl group, an octyl group, a nonyl group, a decyl group, or a dodecyl group, each of which may have a substituent); a substituted or unsubstituted, straight-chained or branched alkenyl group having a carbon atom number of from 2 to 12 (for example, a vinyl group, a propenyl group, a butenyl group, a pentenyl group, a hexenyl group, an octenyl group, a decenyl group, or a dodecenyl group, each of which may have a substituent); a substituted or unsubstituted aralkyl group having a carbon atom number of from 7 to 14 (for example, a benzyl group, a phenetyl group, a 3-phenylpropyl group, a 2-naphthylmethyl group or a 2-naphthylethyl group, each of which may have a substituent); a substituted or unsubstituted alicyclic group having a carbon atom number of from 5 to 10 (for example, a cyclopentyl group, a cyclohexyl group, a 2-cyclohexylethyl group, a 2-cyclopentylethyl group, a norbonyl group, or an adamantyl group, each of which may have a substituent); a substituted or unsubstituted aryl group having a carbon atom number of from 6 to 12 (for example, a phenyl group, or a naphthyl group, each of which may have a substituent); or a substituted or unsubstituted heterocyclic group (condensed or monocyclic) containing an oxygen atom, a nitrogen atom or a sulfur atom (for example, a pyranyl group, a furyl group, a thienyl group, a morpholyl group, a pyrrolyl group, a thiazolyl group, an oxazolyl group, a pyridyl group, a peperidinyl group, a pyrrolidonyl group, a benzothiazolyl group, a benzoxazolyl group, a quinolinyl group, or a tetrahydrofuryl group, each of which may have a substituent). The number of substitutes may be plural. Examples of the substituent include a halogen atom (a chlorine atom, a fluorine atom or a bromine atom), a hydroxyl group, a thiol group, a carboxyl group, a sulfo group, a cyano group, an epoxy group, —OR' (R' represents a hydrocarbon group, for example, a methyl group, an ethyl group, a propyl group, a butyl group, a pentyl group, a hexyl group, a heptyl group, an octyl group, a decyl group, a propenyl group, a butenyl group, a hexenyl group, an octenyl group, a 2-hydroxyethyl group, a 2-chloropropyl group, a 2-cyanoethyl group, an N,N-dimethylaminoethyl group, a 2-bromoethyl group, a 2-(2-methoxyethyl)oxyethyl group, a 2-methoxycarbonylethyl group, a 3-carboxypropyl group, or a benzyl group), —OCOR', —COOR', —COR', —N(R")(R"), in which R" represents a hydrogen atom or the same as those denoted in R' above, provided that the two R"s may be the same or different, —NHCONHR', —NHCOOR', —$Si(R')_3$, —CONHR", or —NHCOR'.

The reactive group Y represents preferably a hydrogen atom, a halogen atom (fluorine, chlorine, bromine, or iodine), —$OR_1$, —$OCOR_2$, —$CH(COR_3)(COR_4)$, —$CH(COR_3)(COOR_4)$, or —$N(R_5)(R_6)$.

In —$OR_1$, $R_1$ represents a substituted or unsubstituted, aliphatic group having a carbon atom number of from 1 to 10 (for example, a methyl group, an ethyl group, a propyl group, a butyl group, a pentyl group, a hexyl group, a heptyl group, an octyl group, a nonyl group, a decyl group, or a dodecyl group, a propenyl group, a butenyl group, a heptenyl group, a hexenyl group, an octenyl group, a decenyl group, a 2-hydroxyethyl group, a 2-hydroxypropyl group, a 2-methoxyethyl group, a 2-(methoxyethyloxy)ethyl group, a 2-(N,N-dimethylamino)ethyl group, a 2-methoxypropyl group, a 2-cyanoethyl group, a 3-methyloxypropyl group, a 2-chloroethyl group, a cyclohexyl group, a cyclopentyl group, a cycloctyl group, a chlorocyclohexyl group, a methoxycyclohexyl group, a benzyl group, a phenethyl group, a dimethoxybenzyl group, a methylbenzyl group or a bromobenzyl group.

In —$OCOR_2$, $R_2$ is preferably the same as those of $R_1$, preferably an aliphatic group or a substituted or unsubstituted aromatic group having a carbon atom number of from 6 to 12, the aromatic group being the same as those denoted in the aryl group of $R_0$.

In —$CH(COR_3)(COR_4)$ and —$CH(COR_3)(COOR_4)$, $R_3$ represents an alkyl group having a carbon atom number of from 1 to 4 (for example, a methyl group, an ethyl group, a propyl group, a butyl group) or an aryl group (for example, a phenyl group, a tolyl group, or a xylyl group), and $R_4$ represents an alkyl group having a carbon atom number of from 1 to 6 (for example, a methyl group, an ethyl group, a propyl group, a butyl group, a pentyl group or a hexyl group), an aralkyl group (for example, a benzyl group, a phnethyl group, a phenylpropyl group, a methylbenzyl group, a methoxybenzyl group, a carboxybenzyl group, or a chlorobenzyl group), or an aryl group (for example, a phenyl group, a tolyl group, a xylyl group, a mesytyl group, a methoxyphenyl group, a chlorophenyl group, a carboxyphenyl group, or a diethoxyphenyl group).

In —$N(R_5)(R_6)$, $R_5$ and $R_6$ may be the same or different, and independently represent preferably a hydrogen atom or a substituted or unsubstituted aliphatic group having a carbon atom number of from 1 to 10 (for example, the same group as those denoted in $R_1$ of —$OR_1$ above. More preferably, the sum of the carbon atom number of $R_5$ and $R_6$ is not more than 12.

The metal M is preferably a transition metal, a rare earth metal or a metal belonging to a group III to a group V of a periodic table, more preferably Al, Si, Sn, Ge, Ti or Zr, more preferably Al, Si, Ti, or Zr, and most preferably Si.

Examples of the metal compound represented by formula (I) will be listed below, but the invention is not limited thereto.

methyltrichlorosilane, methyltribromosilane, methyltrimethoxysilane, methyltriethoxysilane, methyltriisopropoxysilane, methyltrit-butoxysilane, ethyltrichlorosilane, ethyltribromosilane, ethyltrimethoxysilane, ethyltriethoxysilane, ethyltriisopropoxysilane, ethyltrit-butoxysilane, n-propyltrichlorosilane, n-propyltribromosilane, n-propyltrimethoxysilane, n-propyltriethoxysilane, n-propyltriisopropoxysilane, n-propyltrit-butoxysilane, n-hexyltrichlorosilane, n-hexyltribromosilane, n-hexyltrimethoxysilane, n-hexyltriethoxysilane, n-hexyltriisopropoxysilane, n-hexyltrit-butoxysilane, n-decyltrichlorosilane, n-decyltribromosilane, n-decyltrimethoxysilane, n-decyltriethoxysilane, n-decyltriisopropoxysilane, n-decyltrit-butoxysilane, n-octadecyltrichlorosilane, n-octadecyltribromosilane, n-octadecyltrimethoxysilane, n-octadecyltriethoxysilane, n-octadecyltriisopropoxysilane, n-octadecyltrit-butoxysilane, n-phenyltrichlorosilane, n-phenyltribromosilane, n-phenyltrimethoxysilane, n-phenyltriethoxysilane, n-phenyltriisopropoxysilane, n-phenyltrit-butoxysilane, tetrachlorosilane, tetrabromosilane, tetramethoxysilane, tetraethoxysilane, tetraisopropoxysilane, tetrabutoxysilane, dimethoxydiethoxysilane, dimethyldichlorosilane, dimethyldibromosilane, dimethyldimethoxysilane, dimethyldiethoxysilane, diphenyldichlorosilane, diphenyldibromosilane, diphenyldimethoxysilane, diphenyldiethoxysilane, phenylmethyldichlorosilane, phenylmethyldibromosilane, phenylmethyldimethoxysilane, phenylmethyldiethoxysilane, triethoxyhydrosilane, tribromohydrosilane, trimethoxyhydrosilane, triisopropoxyhydrosilane, trit-butoxyhydrosilane, vinyltrichlorosilane, vinyltribromosilane, vinyltrimethoxysilane, vinyltriethoxysilane, vinyltriisopropoxysilane, vinyltrit-butoxysilane, trifluoropropyltrichlorosilane, trifluoropropyltribromosilane, trifluoropropyltrimethoxysilane, trifluoropropyltriethoxysilane, trifluoropropyltriisopropoxysilane, trifluoropropyltrit-butoxysilane, γ-glycidoxypropylmethyldimethoxysilane, γ-glycidoxypropylmethyldiethoxysilane, γ-glycidoxypropyltrimethoxysilane, γ-glycidoxypropyltriethoxysilane, γ-glycidoxypropyltriisopropoxysilane, γ-glycidoxypropyltrit-butoxysilane, γ-methacryloxypropylmethyldimethoxysilane, γ-methacryloxypropylmethyldiethoxysilane, γ-methacryloxypropyltrimethoxysilane, γ-methacryloxypropyltriisopropoxysilane, γ-methacryloxypropyltrit-butoxysilane, γ-aminopropylmethyldimethoxysilane, γ-aminopropylmethyldiethoxysilane, γ-aminopropyltrimethoxysilane, γ-aminopropyltriethoxysilane, γ-aminoropyltriisopropoxysilane, γ-aminopropyltrit-butoxysilane, γ-mercaptopropylmethyldimethoxysilane, γ-mercaptopropylmethyldiethoxysilane, γ-mercaptopropyltrimethoxysilane, γ-mercaptopropyltriethoxysilane, γ-mercaptoropyltriisopropoxysilane, γ-mercaptopropyltrit-butoxysilane, β-(3,4-epoxycyclohexyl)ethyltrimethoxysilane, β-(3,4-epoxycyclohexyl)ethyltriethoxysilane, $Ti(OR)_4$ (in which R represents a methyl group, an ethyl group, a propyl group, a butyl group, a pentyl group or a hexyl group), $TiCl_4$, $Zn(OR)_2$, $Zn(CH_3COCHCOCH_3)_2$, $Sn(OR)_4$, $Sn(CH_3COCHCOCH_3)_4$, $Sn(OCOR)_4$, $SnCl_4$, $Zr(OR)_4$, $Zr(CH_3COCHCOCH_3)_4$, $Al(OR)_3$.

The above metal oxides can be used singly or in combination in order to prepare a metal-containing resin.

As a metal-containing resin with a nitrogen atom-metal atom-nitrogen atom bond, there is, for example, polysilazane.

In the invention, a composite of the metal-containing resin and an organic polymer capable of forming a hydrogen bond with the metal-containing resin is preferably used as a binder resin. The composite of the metal-containing resin and organic polymer may be a substance in the sol or gel form.

The organic polymer has a group (hereinafter referred to as a special bond) capable of forming a hydrogen bond with the metal-containing resin. The special bond is preferably an amido bond (including a carboamido bond or a sulfonamido bond), a urethane bond, a ureido bond, or a hydroxyl group.

The organic polymers include those containing as a repeating unit the special bond in the main or side chain thereof. Preferred examples of the repeated unit include a unit comprising —$N(R_{11})CO$—, —$N(R_{11})SO_2$—, —NHCONH—, —NHCOO—, or —OH, in which $R_{11}$ represents a hydrogen atom or an organic residue which is the same as the hydrocarbon group or heterocyclic group denoted in $R_0$ of formula (I) above.

Examples of the polymer having the special bond include an amide resin having a bond, —$N(R_{11})CO$— or —$N(R_{11})SO_2$—; a ureido resin having a bond, —NHCONH—; or a urethane resin having a bond, —NHCOO—.

Diamines and dicarboxylic acids or disulfonic acids used for manufacturing the amide resin, diisocyanates used for manufacturing the ureido resin, or diols used for manufacturing the urethane resin include those disclosed in Chapter I of "Kobunshi Data Handbook-Kisohen-", edited by Kobunshi Gakkai, published by Baihukan Co., Ltd. (1986), or in S. Yamashita and T. Kaneko, "Kaktuzai Handbook", published by Taisei Co., Ltd. (1981).

As other compounds are preferably used compounds disclosed in paragraphs [0048] to [0057] of Japanese Patent O.P.I. Publication No. 2002-19322.

The organic polymer containing a hydroxyl group may be a natural water-soluble polymer, a semi-synthetic water-soluble polymer, or a synthetic water-soluble polymer, and examples thereof include those described in M. Kotake, "Daiyukikagaku 19, Natural polymer I", published by Asakura Shoten (1960), "Suiyoseikobunshi, Mizubunsangatajushi Sogogijutsusiryoshu", edited by Keiei Kaihatsu Center Shuppanbu (1981), S. Nagatomo, "Shin Suiyoseiporima no Oyo to Shijo", published by CMC Co., Ltd. (1988), or "Kinoseiserurosu no kaihatu", published by CMC Co., Ltd. (1985).

Examples of the natural or semi-synthetic polymer include cellulose; cellulose derivatives (cellulose esters such as cellulose nitrate, cellulose sulfate, cellulose acetate, cellulose propionate, cellulose succinate, cellulose butyrate, cellulose succinate acetate, cellulose acetate butyrate, and cellulose acetate phthalate, cellulose ethers such as methylcellulose, ethylcellulose, cyanoethylcellulose, carboxymethylcellulose, hydroxyethylcellulose, hydroxypropylcellulose, ethylhydroxyethylcellulose, hydroxypropylmethylcellulose, and carboxmethylhydroxyethylcellulose); starch; starch derivatives (oxidized starch, esterified starch such as an ester of starch with nitric acid, sulfuric acid, phosphoric acid, acetic acid, propionic acid, butyric acid, or succinic acid, or etherified starch such as a methyl, ethyl, cyanoethyl, hydroxyalkyl or carboxymethyl ether of starch); alginic acid; pectin; carrageenan; gum tamarind; natural gums (gum arabic, guar gum, locust been gum, gum tragacanth, or xanthan gum); pullulan; dextran; dextran; casein; gelatin; chitin; and chitosan.

Examples of the synthetic polymer include polyvinyl alcohol; polyalkylene glycol (polyethylene glycol, polypropylene glycol, (ethylene glycol/propylene glycol) copolymer); allylalcohol copolymer; (meth)acrylate homopolymers or copolymers having a hydroxyl group (containing for example, 2-hydroxyethyl, 3-hydroxypropyl, 2, 3-dihydroxypropyl, 3-hydroxy-2-hydroxymetyl-2-methylpropyl, 3-hydroxy-2,2-dihydroxymetylpropyl, polyoxyethylene, or polyoxypropylene); N-substituted (meth)acrylamide homopolymers or copolymers (containing, as the N-substituent, for example, monomethylol, 3-hydroxyethyl, 3-hydroxypropyl, 1,1-bis (hydroxymethyl)ethyl, or 2,3,4,5,6-pentahydroxypentyl). However, the synthetic polymer in the invention is not specifically limited as long as it has at least one hydroxyl group in the side chain of the repeated unit.

The weight average molecular weight of the organic polymer in the invention is preferably from 103 to 106, and more preferably from $5\times10^3$ to $4\times10^5$.

In the composite of the metal-containing resin with the organic polymer, the content ratio of the metal-containing resin to the organic polymer widely ranges, but is preferably 10:90 to 90:10 by weight, and more preferably 20:80 to 80:20 by weight.

In a binder resin containing the above composite, the hydroxyl group in the metal-containing resin produced by hydrolytic polycondensation of the above metal compound forms a hydrogen bond with the specific linkage group in the organic polymer to form a uniform organic-inorganic hybrid, whereby a microscopically uniform phase is formed without phase separation. When the metal-containing resin has a hydrocarbon group, it is considered that the hydrocarbon group increases affinity of the resin with the organic polymer. The composite above has organic and inorganic properties, and exhibits strong interaction to organic and inorganic particles, and the binder resin are strongly adsorbed on the particles. Further, the composite exhibits an excellent film forming property.

The composite of the metal-containing resin and the organic polymer is manufactured by condensation-polymerizing hydrolytically the above metal compound and mixing the resulting polycondensate with the organic polymer or by condensation-polymerizing hydrolytically the above metal compound in the presence of the organic polymer. An organic-inorganic polymer composite is preferably manufactured by condensation-polymerizing hydrolytically the above metal compound according to a sol-gel method in the presence of the organic polymer. In the organic-inorganic polymer composite the organic polymer is uniformly dispersed in the matrix (i.e., inorganic metal oxide of three dimensional minute network structure) of gel produced by hydrolytic polycondensation of the metal compound.

The sol-gel method as a preferred method can be carried out in the same manner as a conventional sol-gel method. For example, it can be carried out according to methods described in "Thin-film Coating Technique by Sol-Gel method" published by Gijutujoho Kyokai (1995), S. Sakka, "Zoru-Geruhou no Kagaku", Aguneshohusha Co., Ltd. (1988), and Hirashima, "Saishin Zoru-Geruhou niyoru Kinoseihakumaku Sakuseigijutsu", published by Sogogijutsu senta (1992).

Solvents used are selected from water and organic solvents. Examples pf the organic solvent include alcohols (for example, methanol, ethanol, propyl alcohol, ethylene glycol, diethylene glycol, propylene glycol, dipropylene glycol, ethylene glycol monomethyl ether, propylene glycol monomethyl ether, ethylene glycol monoethyl ether, etc.); ethers (for example, tetrahydrofuran, ethylene glycol dimethyl ether, propylene glycol dimethyl ether, tetrahydropyran, etc.); ketones (for example, acetone, methyl ethyl ketone, acetylacetone, etc.); esters (for example, methyl acetate, ethylene glycol monomethyl monoacetate, etc.); and amides (for example, formamide, N-methylformamide, pyrrolidone, N-methylpyrrolidone, etc.). The above solvents may be used singly or as a mixture of two or more kinds thereof.

When the above composite is used, an acid catalyst or a base catalyst is preferably used in order to promote hydrolysis or polycondensation reaction of the above metal compound represented by formula (I). An acid or base compound itself, or a solution in which the acid or base compound is dissolved in a solvent (referred to as an acid catalyst or a base catalyst, respectively) is used as a catalyst. The catalyst concentration is not specifically limited. When the concentration is high, a rate of hydrolysis or polycondensation reaction tends to increase. Since the high concentration of a base catalyst may produce precipitates in a sol solution, the concentration of the base catalyst is preferably not more than 1 mol/liter (in the aqueous solution).

The kind of the acid catalyst or base catalyst used is not specifically limited. When it is necessary to use a catalyst at a high concentration, a catalyst comprising an element, which does not remain in catalyst crystal particles after reaction, is preferably used. Typical examples of such an acid catalyst include hydrogen halide such as hydrochloric acid, nitric acid, sulfuric acid, sulfinic acid, hydrogen sulfide, hydrogen perchlorate, hydrogen carbonate, a carboxylic acid such as formic acid or acetic acid, a substituted carboxylic acid represented by RCOOH in which R represents another element or a substituent, and sulfonic acid such as benzene sulfonic acid. Typical examples of such a base catalyst include an ammoniacal base such as ammonia water, and amines such as ethylamine and aniline.

The binder resin is used in an amount of 8 to 50 parts by weight, and preferably from 10 to 30 parts by weight, based on 1oo parts by weight of particles. This binder resin amount efficiently realizes advantageous effects of the invention.

A cross-linking agent may be added. As the cross-linking agent, a compound usually used as a cross-linking agent can be used. For example, compounds, described in "Kakyozai Handbook" edited by S. Yamashita and T. Kaneko, published by Taisei Sha (1981), or in "Kobunshi Deta Handbook, Kisohen" edited by Kobunshi Gakkai, published by Baihukan (1986), can be used.

Examples of the cross-linking agent include ammonium chloride, a metal ion, organic peroxides, polyisocyanate (for example, toluylene diisocyanate, diphenylmethane diisocyanate, triphenylmethane trisocyanate, polyethylene phenyl isocyanate, hexamethylene diisocyanate, isophorone diisocyanate, polyisocyanates, etc.); polyol compounds (for example, 1,4-butane diol, polyoxypropylene glycol, polyoxyethylene glycol, 1,1,1-trimethylol propane, etc.); polyamine compounds (for example, ethylenediamine, γ-hydroxypropylethylenediamine, phenylenediamine, hexamethylenediamine, N-aminoethylpiperazine, modified aliphatic amines, etc.); polyepoxy group-containing compounds or epoxy resins (for example, compounds described in H. Kakiuchi, "Shin Epokisi Jushi", published by Shoko Do (1985), and K. Hashimoto, "Epokishi Jushi", published by by Nikkankogyo Shinbunsha (1969)); melamine resins (for example, compounds described in "Yuria-Meramin Jushi", edited by I. Mitsuwa, H. Matsunaga, published by Nikkankogyo Shinbunsha (1969)); and polymethacrylate compounds (for example, compounds described in "Oligomer", edited by S. Ogawara, T. Saegusa, T. Higashimura, published by Kodansha (1976) and "Kinosei Akurirujushi", edited by E. Omori, published by Tekunosisutemu (1985)).

In the invention, an overcoat layer may be provided on the layer containing the above matting agent. The overcoat layer is comprised of a film-forming resin, and as the film-forming resin, the same as the binder resins denoted above in the layer containing the matting agent can be used. Preferably, a hydrophilic overcoat layer is provided on a layer containing a hydrophilic binder resin and a matting agent or a hydrophobic overcoat layer is provided on an uneven surface of a layer containing a hydrophobic binder resin, whereby good adhesion of the overcoat layer to the matting agent-containing layer is realized.

The overcoat layer can be formed by coating a coating solution containing a solvent and the above-described film-forming resin on the matting agent-containing layer according to a conventional coating method, and then drying. As the solvent, the solvent described above can be used. Examples of the coating method include coater coating (air doctor coating, blade coating, rod coating, squeegee coating, or gravure coating), and spray coating (air spray or electrostatic coating).

In order to mount and fix the underlay sheet on a plate cylinder of a press, a conventional method is used. There is, for example, a method providing an agglutinant or an adhesive such as spray paste or an adhesive double coated tape on the backing layer surface of the underlay sheet, or a method gripping the leading edge and the rear edge of the underlay sheet with a gripper provided on the plate cylinder to fix the underlay sheet on the plate cylinder. The combined method of the two methods above can be used.

One of the characteristics of the invention is to use a plastic sheet support as a support of the printing plate material. The support is preferably a polyester film sheet having a thickness distribution of not more than 10%. Next, the polyester film sheet will be explained.

[Polyester Film Sheet Support]

In the invention, the polyester film sheet has a thickness distribution of not more than 10%, preferably not more than 8%, still more preferably not more than 6%, and most preferably 0%.

In the invention, the thickness distribution of the polyester film sheet is determined according to the following: lines are formed at an interval of 10 cm in both the transverse and longitudinal directions on a 60 cm square polyester film sheet to form 36 small squares. The thicknesses of the 36 small squares are measured, and the average thickness, maximum thickness and minimum thickness are obtained. The thickness distribution is a value (%) obtained by dividing the difference between the maximum thickness and the minimum thickness by the average thickness and then multiplying the difference by 100.

The polyester used in the polyester film sheet is not specifically limited, and contains, as a main component, a dicarboxylic acid unit and a diol unit. There are, for example, polyethylene terephthalate (hereinafter also referred to as PET), and polyethylene naphthalate (hereinafter also referred to as PEN). The polyester is preferably PET, a copolyester comprising a PET component as a main component in an amount of not less than 50% by weight, or a polymer blend comprising PET in an amount of not less than 50% by weight.

PET is a polycondensate of terephthalic acid and ethylene glycol, and PEN is a polycondensate of naphthalene dicarboxylic acid and ethylene glycol. The polyester may be a polycondensate of the dicarboxylic acid and diol, constituting PET or PEN, and one or more kinds of a third component. As the third component, there is a compound capable of forming an eater. As a dicarboxylic acid, there is, for example, terephthalic acid, isophthalic acid, phthalic acid, 2,6-naphthalene dicarboxylic acid, 2,7-naphthalene dicarboxylic acid, diphenylsulfone dicarboxylic acid, diphenylether dicarboxylic acid, diphenylthioether dicarboxylic acid, diphenylketone dicarboxylic acid, diphenylindane dicarboxylic acid, and as a diol, there is, for example, propylene glycol, tetramethylene glycol, cyclohexanedimethanol, 2,2-bis(4-hydroxyphenyl)propane, 2,2-bis(4-hydroxyethoxyphenyl)propane, bis(4-hydroxyphenyl)sulfone, bisphenolfluorene dihydroxyethyl ether, diethylene glycol, hydroquinone, cyclohexane diol. The third component may be a polycarboxylic acid or a polyol, but the content of the polycarboxylic acid or polyol is preferably from 0.001 to 5% by weight based on the weight of polyester.

The intrinsic viscosity of the polyester in the invention is preferably from 0.5 to 0.8. Polyesters having different viscosity may be used as a mixture of two or more kinds thereof.

A manufacturing method of the polyester in the invention is not specifically limited, and the polyester can be manufactured according to a conventional polycondensation method. As the manufacturing method, there is a direct esterification method in which a dicarboxylic acid is directly reacted with a diol by heat application to be esterified while distilling off the extra diol at elevated temperature under reduced pressure, or an ester exchange method.

As catalysts, an ester exchange catalyst ordinarily used in synthesis of polyesters, a polymerization catalyst or a heat-resistant stabilizer can be used. Examples of the ester exchange catalyst include $Ca(OAc)_2.H_2O$, $Zn(OAc)_2.2H_2O$, $Mn(OAc)_2.4H_2O$, and $Mg(OAc)_2.4H_2O$. Examples of the polymerization catalyst include $Sb_2O_3$ and $GeO_2$. Examples of the heat-resistant stabilizer include Phosphoric acid, phosphorous acid, $PO(OH)(CH_3)_3$, $PO(OH)(OC_6H_5)_3$, and $P(OC_6H_5)_3$. During synthesis of polyesters, an anti-stain agent, a crystal nucleus agent, a slipping agent, an anti-blocking agent, a UV absorber, a viscosity adjusting agent, a transparentizing agent, an anti-static agent, a pH adjusting agent, a dye or pigment may be added.

The polyester film sheet support used in the invention has a thickness of preferably from 80 to 400 μm, and more preferably 120 to 300 μm.

(Preparation of Support)

In order to obtain an average thickness or thickness distribution of the support in the invention falling within the range described above, it is preferred that the support is prepared according to the following procedures.

The support in the invention is prepared by a method comprising the steps of melting a thermoplastic resin at a temperature of from the melting point (Tm) to Tm+50° C., filtering the melted resin through a filter, extruding the filtrate from a T-die, and casting it on a casting drum at a glass transition point (Tg)−50° C. to Tg to form an unstretched sheet. As a method to obtain the support with the thickness variation falling within the above-described range, a static electricity application method is preferably used. The unstretched sheet is stretched at from Tg to Tg+50° C. by a stretching magnification of from 2 to 4. As another method to obtain the support with the thickness variation falling within the above-described range, a multi-stretching method is preferably used, in which temperature at a later stretching step is higher than that at a preceding stretching step by preferably 1 to 30° C., and more preferably 2 to 15° C.

The stretching magnification at the preceding stretching step is preferably 0.25 to 0.75 times, and more preferably 0.3 to 0.5 times the stretching magnification at the later stretching step. Thereafter, it is preferred that the stretched sheet is maintained at Tg−30° C. to Tg for 5 to 60 seconds, preferably 10 to 40 seconds, and stretched in the lateral direction at Tg to Tg+50° C. by a stretching magnification of 2.5 to 5. The resulting sheet, while held through a chuck at (Tm−50° C.) to (Tm−5° C.), is heat fixed, where the interval of the chucks in the lateral direction is preferably reduced by more than 0 to 10% (heat relaxation). The heat fixed sheet is cooled, subjected to knurling treatment to give a knurl of 10 to 100 μm at the sheet edge, and wounded around a spool. Thus, a multi-axially stretched film sheet is preferably obtained.

(Heat Treatment of Support)

In the invention, the polyester film sheet after stretched and heat-fixed is preferably subjected to heat treatment in order to stabilize dimension of a printing plate and minimize "out of color registration" during printing. After the sheet has been stretched, heat fixed, cooled, wound around a spool once, and unwound, the sheet is properly heat treated at a separate process as follows.

As the heat treatment methods in the invention, there are a transporting method in which the film sheet is transported while holding the both ends of the sheet with a pin or a clip, a transporting method in which the film sheet is roller transported employing plural transporting rollers, an air transporting method in which the sheet is transported while lifting the sheet by blowing air to the sheet (heated air is blown to one or both sides of the sheet from plural nozzles), a heating method which the sheet is heated by radiation heat from for example, an infrared heater, a heating method in which the sheet is brought into contact with plural heated rollers to heat the sheet, a transporting method in which the sheet hanging down by its own weight is wound around an up-take roller, and a combination thereof.

Tension at heat treatment can be adjusted by controlling torque of an up-take roll and/or a feed-out roll and/or by controlling load applied to the dancer roller provided in the process. When the tension is changed during or after the heat treatment, an intended tension can be obtained by controlling load applied to the dancer roller provided in the step before, during and/or after the heat treatment. When the transporting tension is changed while vibrating the sheet, it is useful to reduce the distance the heated rollers.

In order to reduce dimensional change on heat processing (thermal development), which is carried out later, without inhibiting thermal contraction, it is desirable to lower the transporting tension as much as possible, and lengthen the heat treatment time. The heat treatment temperature is preferably in the range of from Tg+50° C. to Tg+150° C. In this temperature range, the transporting tension is preferably from 5 Pa to 1 MPa, more preferably from 5 Pa to 500 kPa, and most preferably from 5 Pa to 200 kPa, and the heat treatment time is preferably from 30 seconds to 30 minutes, and more preferably from 30 seconds to 15 minutes. The above described temperature range, transporting tension range and heat treatment time range can prevent the support planarity from lowering due to partial thermal contraction difference of the support occurring during heat treatment and prevent scrapes from occurring on the support due to friction between the support and transporting rollers.

In the invention, it is preferred that the heat treatment is carried out at least once, in order to obtain an intended dimensional variation rate. The heat treatment can be optionally carried out two or more times.

In the invention, the heat-treated polyester film sheet is cooled from a temperature of around Tg to room temperature and wound around a spool. During cooling to room temperature from a temperature exceeding Tg, the heat-treated polyester film sheet is preferably cooled at a rate of not less than (−) 5° C./second in order to prevent lowering of flatness of the sheet due to cooling.

In the invention, the heat treatment is preferably carried out after the subbing layer described above has been coated. There is, for example, a method in which the polyester film sheet is inline coated with the subbing layer between the heat fixing step and the cooling step, wound around a spool, and thereafter, the wound sheet is heat fixed or a method in which the heat fixed polyester film sheet, being wound around a spool, is coated with a subbing layer in a separate line to obtain a subbed polyester film sheet, and successively, the subbed film maintained horizontally is heat treated. Further, the same heat treatment as above may be carried out after various functional layers such as a backing layer, a conductive layer, a lubricant layer and a subbing layer have been coated.

(Water Content of Support)

In the invention, in order to secure good transportability of the support in an exposure device or in a developing machine, the water content of the support is preferably not more than 0.5 by weight.

The water content of the support in the invention is D' represented by the following formula:

$$D' \text{ (weight \%)} = (w'/W') \times 100$$

wherein W' represents the weight of the support in the equilibrium state at 25° C. and 60% RH, and w' represents the weight of water contained in the support in the equilibrium state at 25° C. and 60% RH.

The water content of the support is preferably not more than 0.5% by weight, more preferably from 0.01 to 0.5% by weight, and most preferably from 0.01 to 0.3% by weight.

As a method of obtaining a support having a water content of not more than 0.5% by weight, there is (1) a method in which the support is heat treated at not less than 100° C. immediately before an image formation layer or another layer is coated on the support, (2) a method in which an image formation layer or another layer is coated on the support under well-controlled relative humidity, and (3) a method in which the support is heat treated at not less than 100° C. immediately before an image formation layer or another layer is coated on the support, covered with a moisture shielding sheet, and then uncovered. Two or more of these methods may be used in combination.

(Adhesion Increasing Treatment to the Support and Subbing Layer Coating on the Support)

In order to increase adhesion between the support and a coating layer, it is preferred that the surface of the support is subjected to adhesion increasing treatment or is coated with a subbing layer. Examples of the adhesion increasing treatment include corona discharge treatment, flame treatment, plasma treatment and UV light irradiation treatment.

The subbing layer is preferably, more preferably a layer containing gelatin or latex. A conductive layer containing a conductive polymer disclosed in Japanese Patent O.P.I. Publication No. 7-20596, items [0031–]–[0073] or a conductive layer containing a metal oxide disclosed in Japanese Patent O.P.I. Publication No. 7-20596, items [0074]–[0081] is preferably provided on the support. The conductive layer may be provided on one side or on both sides of the polyester film sheet support. It is preferred that the conductive layer be provided on the image formation layer side of the support. The conductive layer restrains electrostatic charging, reduces dust deposition on the support, and greatly reduces white spot faults at image portions during printing.

The support in the invention is preferably a polyester film sheet, but may be a composite support in which a plate of a metal (for example, iron, stainless steel or aluminum) or a polyethylene-laminated paper sheet is laminated onto a polyester film sheet. The composite support may be one in which the lamination is carried out before any layer is coated on the support, one in which the lamination is carried out after any layer has been coated on the support, or one in which the lamination is carried out immediately before mounted on a printing press.

(Particles)

Particles having a size of from 0.01 to 10 μm are preferably incorporated in an amount of from 1 to 1000 ppm into the support, in improving handling property.

Herein, the particles may be organic or inorganic material. Examples of the inorganic material include silica described in Swiss Patent 330158, glass powder described in French Patent 296995, and carbonate salts of alkaline earth metals, cadmium or zinc described in British Patent 1173181. Examples of the organic material include starch described in U.S. Pat. No. 2,322,037, starch derivatives described such as in Belgian Patent 625451 and British Patent 981198, polyvinyl alcohol described in JP-B 44-3643, polystyrene or polymethacrylate described in Swiss Patent 330158, polyacrylonitrile described in U.S. Pat. No. 3,079,257 and polycarbonate described in U.S. Pat. No. 3,022,169. The shape of the particles may be in a regular form or irregular form.

The printing plate material in the invention comprises a polyester film sheet support, and provided thereon, an image formation layer, wherein an image capable of being printed is formed on the image formation layer after imagewise exposed or after imagewise exposed and developed. The printing plate material in the invention is preferably a planographic printing plate material forming an image according to a silver salt diffusion transfer method disclosed in Japanese Patent O.P.I. Publication No. 4-261539, an ablation type planographic printing plate material forming an image employing a thermal laser or a thermal head, or a silver salt diffusion transfer method disclosed in JP-8-507727 or Japanese Patent O.P.I. Publication No. 6-186750, a heat melt image layer on-press development type planographic printing plate material or a heat fusible transfer type planographic printing plate material disclosed in Japanese Patent O.P.I. Publication No. 9-123387. Among these, an ablation type planographic printing plate material, a heat melt image layer on-press development type planographic printing plate material or a heat fusible transfer type planographic printing plate material, each being a processless CTP printing plate material, is preferred since load to environment is reduced. The planographic printing plate material is preferred which comprises the polyester film sheet support and provided thereon, an image formation layer containing heat melt particles or heat fusible particles.

[Image Formation Layer]

The image formation layer in the invention preferably contains heat melting particles and/or heat fusible particles.

(Heat Melting Particles)

The heat melting particles used in the invention are particularly particles having a low melt viscosity, or particles formed from materials generally classified into wax. The materials preferably have a softening point of from 40° C. to 120° C. and a melting point of from 60° C. to 150° C., and more preferably a softening point of from 40° C. to 100° C. and a melting point of from 60° C. to 120° C. The melting point less than 60° C. has a problem in storage stability and the melting point exceeding 300° C. lowers ink receptive sensitivity.

Materials usable include paraffin, polyolefin, polyethylene wax, microcrystalline wax, and fatty acid wax. The molecular weight thereof is approximately from 800 to 10,000. A polar group such as a hydroxyl group, an ester group, a carboxyl group, an aldehyde group and a peroxide group may be introduced into the wax by oxidation to increase the emulsification ability. Moreover, stearoamide, linolenamide, laurylamide, myristylamide, hardened cattle fatty acid amide, parmitylamide, oleylamide, rice bran oil fatty acid amide, palm oil fatty acid amide, a methylol compound of the above-mentioned amide compounds, methylenebissteastearoamide and ethylenebissteastearoamide may be added to the wax to lower the softening point or to raise the working efficiency. A cumarone-indene resin, a rosin-modified phenol resin, a terpene-modified phenol resin, a xylene resin, a ketone resin, an acryl resin, an ionomer and a copolymer of these resins may also be usable.

Among them, polyethylene, microcrystalline wax, fatty acid ester and fatty acid are preferably contained. A high sensitive image formation can be performed since these materials each have a relative low melting point and a low melt viscosity. These materials each have a lubrication ability. Accordingly, even when a shearing force is applied to the surface layer of the printing plate precursor, the layer damage is minimized, and resistance to contaminations which may be caused by scratch is further enhanced.

The heat melting particles are preferably dispersible in water. The average particle size thereof is preferably from 0.01 to 10 μm, and more preferably from 0.05 to 3 μm. When a layer containing the heat melting particles is coated on a porous hydrophilic layer described later, the particles having an average particle size less than 0.01 μm may enter the pores of the hydrophilic layer or the valleys between the neighboring two peaks on the hydrophilic layer surface, resulting in insufficient on press development and background contaminations. The particles having an average particle size exceeding 10 μm may result in lowering of dissolving power.

The composition of the heat melting particles may be continuously varied from the interior to the surface of the particles. The particles may be covered with a different material. Known microcapsule production method or sol-gel method can be applied for covering the particles. The heat melting particle content of the layer is preferably 1 to 90% by weight, and more preferably 5 to 80% by weight based on the total layer weight.

(Heat Fusible Particles)

The heat fusible particles in the invention include thermoplastic hydrophobic polymer particles. Although there is no specific limitation to the upper limit of the softening point of the thermoplastic hydrophobic polymer particles, the softening point is preferably lower than the decomposition temperature of the polymer particles. The weight average molecular weight (Mw) of the polymer is preferably within the range of from 10,000 to 1,000,000.

Examples of the polymer consistituting the polymer particles include a diene (co)polymer such as polypropylene, polybutadiene, polyisoprene or an ethylene-butadiene copolymer; a synthetic rubber such as a styrene-butadiene copolymer, a methyl methacrylate-butadiene copolymer or an acrylonitrile-butadiene copolymer; a (meth)acrylate (co) polymer or a (meth)acrylic acid (co)polymer such as polymethyl methacrylate, a methyl methacrylate-(2-ethylhexyl) acrylate copolymer, a methyl methacrylate-methacrylic acid copolymer, or a methyl acrylate-(N-methylolacrylamide); polyacrylonitrile; a vinyl ester (co)polymer such as a polyvinyl acetate, a vinyl acetate-vinyl propionate copolymer and a vinyl acetate-ethylene copolymer, or a vinyl acetate-2-hexylethyl acrylate copolymer; and polyvinyl chloride, polyvinylidene chloride, polystyrene and a copolymer thereof. Among them, the (meth)acrylate polymer, the (meth)acrylic acid (co)polymer, the vinyl ester (co)polymer, the polystyrene and the synthetic rubbers are preferably used.

The polymer particles may be prepared from a polymer synthesized by any known method such as an emulsion polymerization method, a suspension polymerization method, a solution polymerization method and a gas phase polymerization method. The particles of the polymer synthesized by the solution polymerization method or the gas phase polymerization method can be produced by a method in which an organic solution of the polymer is sprayed into an inactive gas and dried, and a method in which the polymer is dissolved in a water-immiscible solvent, then the resulting solution is dispersed in water or an aqueous medium and the solvent is removed by distillation. In both of the methods, a surfactant such as sodium lauryl sulfate, sodium dodecylbenzenesulfate or polyethylene glycol, or a water-soluble resin such as poly(vinyl alcohol) may be optionally used as a dispersing agent or stabilizing agent.

The heat fusible particles are preferably dispersible in water. The average particle size of the heat fusible particles is preferably from 0.01 to 10 μm, and more preferably from 0.1 to 3 μm. When a layer containing the heat fusible particles having an average particle size less than 0.01 μm is coated on the porous hydrophilic layer, the particles may enter the pores of the hydrophilic layer or the valleys between the neighboring two peaks on the hydrophilic layer surface, resulting in insufficient on press development and background contaminations. The heat fusible particles having an average particle size exceeding 10 μm may result in lowering of dissolving power.

Further, the composition of the heat fusible particles may be continuously varied from the interior to the surface of the particles. The particles may be covered with a different material. As a covering method, known methods such as a microcapsule method and a sol-gel method are usable. The heat fusible particle content of the layer is preferably from 1 to 90% by weight, and more preferably from 5 to 80% by weight based on the total weight of the layer.

It is preferred that the image formation layer in the invention contains a light-to-heat conversion material.

The dry coating amount of the image formation layer is preferably from 0.10 to 1.50 g/m$^2$, and more preferably from 0.15 to 1.00 g/m$^2$.

[Hydrophilic Layer]

In the invention, the printing plate material comprises at least one hydrophilic layer between the support and the image formation layer. Next, the hydrophilic layer in the invention, which is provided between the support and the image formation layer, will be explained. The hydrophilic layer is defined as a layer exhibiting high repellency to ink and high affinity to water in the printing plate material.

In the printing plate material of the invention, at least one hydrophilic layer provided on the support preferably has a porous structure. In order to form the hydrophilic layer having such a porous structure, materials described later forming a hydrophilic matrix phase are used.

(Metal Oxide)

Material for forming a hydrophilic matrix phase is preferably a metal oxide. The metal oxide preferably comprises metal oxide particles. Examples of the metal oxide particles include particles of colloidal silica, alumina sol, titania sol and another metal oxide sol. The metal oxide particles may have any shape such as spherical, needle-like, and feather-like shape. The average particle size is preferably from 3 to 10.0 nm, and plural kinds of metal oxide each having a different size may be used in combination. The surface of the particles may be subjected to surface treatment.

The metal oxide particles can be used as a binder, utilizing its layer forming ability. The metal oxide particles are suitably used in a hydrophilic layer since they minimize lowering of the hydrophilicity of the layer as compared with an organic compound binder.

(Colloidal Silica)

Among the above-mentioned, colloidal silica is particularly preferred. The colloidal silica has a high layer forming ability under a drying condition with a relative low temperature, and can provide a good layer strength. It is preferred that the colloidal silica used in the invention is necklace-shaped colloidal silica or colloidal silica particles having an average particle size of not more than 20 nm, each being described later. Further, it is preferred that the colloidal silica provides an alkaline colloidal silica solution as a colloid solution.

The necklace-shaped colloidal silica to be used in the invention is a generic term of an aqueous dispersion system of a spherical silica having a primary particle size of the order of nm. The necklace-shaped colloidal silica to be used in the invention means a "pearl necklace-shaped" colloidal silica formed by connecting spherical colloidal silica particles each having a primary particle size of from 10 to 50 μm so as to attain a length of from 50 to 400 nm. The term of "pearl necklace-shaped" means that the image of connected colloidal silica particles is like to the shape of a pearl necklace.

The bonding between the silica particles forming the necklace-shaped colloidal silica is considered to be —Si—O—Si—, which is formed by dehydration of —SiOH groups located on the surface of the silica particles. Concrete examples of the necklace-shaped colloidal silica include Snowtex-PS series produced by Nissan Kagaku Kogyo, Co., Ltd. As the products, there are Snowtex-PS-S (the average particle size in the connected state is approximately 110 nm), Snowtex-PS-M (the average particle size in the connected state is approximately 120 nm) and Snowtex-PS-L (the average particle size in the connected state is approximately 170 nm). Acidic colloidal silicas corresponding to each of the above-mentioned are Snowtex-PS-S-O, Snowtex-PS-M-O and Snowtex-PS-L-O, respectively.

The necklace-shaped colloidal silica is preferably used in a hydrophilic layer as a porosity providing material for hydrophilic matrix phase, and porosity and strength of the layer can be secured by its addition to the layer. Among them, the use of Snowtex-PS-S, Snowtex-PS-M or Snowtex-PS-L, each being alkaline colloidal silica particles, is particularly preferable since the strength of the hydrophilic layer is increased and occurrence of background contamination is inhibited even when a lot of prints are printed.

It is known that the binding force of the colloidal silica particles is become larger with decrease of the particle size. The average particle size of the colloidal silica particles to be used in the invention is preferably not more than 20 nm, and more preferably 3 to 15 nm. As above-mentioned, the alkaline colloidal silica particles show the effect of inhibiting occurrence of the background contamination. Accordingly, the use of the alkaline colloidal silica particles is particularly preferable. Examples of the alkaline colloidal silica particles having the average particle size within the foregoing range include Snowtex-20 (average particle size: 10 to 20 nm), Snowtex-30 (average particle size: 10 to 20 nm), Snowtex-40 (average particle size: 10 to 20 nm), Snowtex-N (average particle size: 10 to 20 nm), Snowtex-S (average particle size: 8 to 11 nm) and Snowtex-XS (average particle size: 4 to 6 nm), each produced by Nissan Kagaku Co., Ltd.

The colloidal silica particles having an average particle size of not more than 20 nm, when used together with the necklace-shaped colloidal silica as described above, is particularly preferred, since porosity of the layer is maintained and the layer strength is further increased. The ratio of the colloidal silica particles having an average particle size of not more than 20 nm to the necklace-shaped colloidal silica is preferably from 95/5 to 5/95, more preferably from 70/30 to 20/80, and most preferably from 60/40 to 30/70.

(Porous Metal Oxide Particles)

The hydrophilic layer of the printing plate precursor of the invention contains porous metal oxide particles as metal oxides. Examples of the porous metal oxide particles include porous silica particles, porous aluminosilicate particles or zeolite particles as described later.

<Porous Silica or Porous Aluminosilicate Particles>

The porous silica particles are ordinarily produced by a wet method or a dry method. By the wet method, the porous silica particles can be obtained by drying and pulverizing a gel prepared by neutralizing an aqueous silicate solution, or pulverizing the precipitate formed by neutralization. By the dry method, the porous silica particles are prepared by combustion of silicon tetrachloride together with hydrogen and oxygen to precipitate silica. The porosity and the particle size of such particles can be controlled by variation of the production conditions. The porous silica particles prepared from the gel by the wet method is particularly preferred.

The porous aluminosilicate particles can be prepared by the method described in, for example, JP O.P.I. No. 10-71764. Thus prepared aluminosilicate particles are amorphous complex particles synthesized by hydrolysis of aluminum alkoxide and silicon alkoxide as the major components. The particles can be synthesized so that the ratio of alumina to silica in the particles is within the range of from 1:4 to 4:1. Complex particles composed of three or more components prepared by an addition of another metal alkoxide may also be used in the invention. In such a particle, the porosity and the particle size can be controlled by adjustment of the production conditions.

The porosity of the particles is preferably not less than 1.0 ml/g, more preferably not less than 1.2 ml/g, and most preferably of from 1.8 to 2.5 ml/g, in terms of pore volume. The pore volume is closely related to water retention of the coated layer. As the pore volume increases, the water retention is increased, contamination is difficult to occur, and the water retention latitude is broad. Particles having a pore volume of more than 2.5 ml/g are brittle, resulting in lowering of durability of the layer containing them. Particles having a pore volume of less than 0.5 ml/g may be insufficient in printing performance.

(Measurement of Pore Volume)

Measurement of the pore volume is carried out employing AUTOSORB-1 produced by Quantachrome Co., Ltd. Assuming that the voids of particles are filled with a nitrogen gas, the pore volume is calculated from a nitrogen gas adsorption amount at a relative pressure of 0.998.

(Zeolite Particles)

Zeolite is a crystalline aluminosilicate, which is a porous material having voids of a regular three dimensional net work structure and having a pore size of 0.3 to 1 nm. Natural and synthetic zeolites are expressed by the following formula.

$$(M_1.(M_2)_{0.5})_m(Al_mSi_nO_{2(m+n)}).xH_2O$$

In the above, $M_1$ and $M_2$ are each exchangeable cations. Examples of $M_1$ include $Li^+$, $Na^+$, $K^+$, $Tl^+$, $Me_4N^+$ (TMA), $Et_4N^+$ (TEA), $Pr_4N^+$ (TPA), $C_7H_{15}N^{2+}$, and $C_8H_{16}N^+$, and examples of $M^2$ include $Ca^{2+}$, $Mg^{2+}$, Ba $^2$+, $Sr^{2+}$ and $C_8H_{18}N_2{}^{2+}$. Relation of n and m is n≧m, and consequently, the ratio of m/n, or that of Al/Si is not more than 1. A higher Al/Si ratio shows a higher content of the exchangeable cation, and a higher polarity, resulting in higher hydrophilicity. The Al/Si ratio is within the range of preferably from 0.4 to 1.0, and more preferably 0.8 to 1.0. x is an integer.

Synthetic zeolite having a stable Al/Si ratio and a sharp particle size distribution is preferably used as the zeolite particles to be used in the invention. Examples of such zeolite include Zeolite A: $Na_{12}(Al_{12}Si_{12}O_{48}).27H_2O$; Al/Si=1.0, Zeolite X: $Na_{86}(Al_{86}Si_{106}O_{384}).\ 264H_2O$; Al/Si=0.811, and Zeolite Y: $Na_{56}(Al_{56}Si_{136}O_{384}).250H_2O$; Al/Si=0.412.

Containing the porous zeolite particles having an Al/Si ratio within the range of from 0.4 to 1.0 in the hydrophilic layer greatly raises the hydrophilicity of the hydrophilic layer itself, whereby contamination in the course of printing is inhibited and the water retention latitude is also increased. Further, contamination caused by a finger mark is also greatly reduced. When Al/Si is less than 0.4, the hydrophilicity is insufficient and the above-mentioned improving effects are lowered.

The hydrophilic matrix phase constituting the hydrophilic layer in the invention can contain layer structural clay mineral particles as a metal oxide. Examples of the layer structural clay mineral particles include a clay mineral such as kaolinite, halloysite, talk, smectite such as montmorillonite, beidellite, hectorite and saponite, vermiculite, mica and chlorite; hydrotalcite; and a layer structural polysilicate such as kanemite, makatite, ilerite, magadiite and kenyte. Among them, ones having a higher electric charge density of the unit layer are higher in the polarity and in the hydrophilicity. Preferable charge density is not less than 0.25, more preferably not less than 0.6. Examples of the layer structural mineral particles having such a charge density include smectite having a negative charge density of from 0.25 to 0.6 and bermiculite having a negative charge density of from 0.6 to 0.9. Synthesized fluorinated mica is preferable since one having a stable quality, such as the particle size, is available. Among the synthesized fluorinated mica, swellable one is preferable and one freely swellable is more preferable.

An intercalation compound of the foregoing layer structural mineral particles such as a pillared crystal, or one treated by an ion exchange treatment or a surface treatment such as a silane coupling treatment or a complication treatment with an organic binder is also usable.

With respect to the size of the planar structural mineral particles, the particles have an average particle size (an average of the largest particle length) of preferably not more than 20 μm, and more preferably not more than 10 μm, and an average aspect ratio (the largest particle length/the particle thickness of preferably not less than 20, and more preferably not less than 50, in a state contained in the layer including the case that the particles are subjected to a swelling process and a dispersing layer-separation process. When the particle size is within the foregoing range, continuity to the parallel direction, which is a trait of the layer structural particle, and softness, are given to the coated layer so that a strong dry layer in which a crack is difficult to be formed can be obtained. The coating solution containing the layer structural clay mineral particles in a large amount can minimize particle sedimentation due to a viscosity increasing effect. The particle size greater than the foregoing may produce a non-uniform coated layer, resulting in poor layer strength. The aspect ratio lower than the foregoing reduces the planar particles, resulting in insufficient viscosity increase and reduction of particle sedimentation inhibiting effect.

The content of the layer structural clay mineral particles is preferably from 0.1 to 30% by weight, and more preferably from 1 to 10% by weight based on the total weight of the layer. Particularly, the addition of the swellable synthesized fluorinated mica or smectite is effective if the adding amount is small. The layer structural clay mineral particles may be added in the form of powder to a coating liquid, but it is preferred that gel of the particles which is obtained by being swelled in water, is added to the coating liquid in order to obtain a good dispersity according to an easy coating liquid preparation method which requires no dispersion process comprising dispersion due to media.

An aqueous solution of a silicate is also usable as another additive to the hydrophilic matrix phase. An alkali metal silicate such as sodium silicate, potassium silicate or lithium silicate is preferable, and the $SiO_2/M_2O$ is preferably selected so that the pH value of the coating liquid after addition of the silicate exceeds 13 in order to prevent dissolution of the porous metal oxide particles or the colloidal silica particles.

An inorganic polymer or an inorganic-organic hybrid polymer prepared by a sol-gel method employing a metal alkoxide. Known methods described in S. Sakka "Application of Sol-Gel Method" or in the publications cited in the above publication can be applied to prepare the inorganic polymer or the inorganic-organic hybrid polymer by the sol-gel method.

In the invention, a water soluble resin may be contained. Examples of the water soluble resin include polysaccharides, polyethylene oxide, polypropylene oxide, polyvinyl alcohol, polyethylene glycol (PEG), polyvinyl ether, a styrene-butadiene copolymer, a conjugation diene polymer latex of methyl methacrylate-butadiene copolymer, an acryl polymer latex, a vinyl polymer latex, polyacrylamide, and polyvinyl pyrrolidone. In the invention, polysaccharides are preferably used as the water soluble resin.

As the polysaccharide, starches, celluloses, polyuronic acid and pullulan can be used. Among them, a cellulose derivative such as a methyl cellulose salt, a carboxymethyl cellulose salt or a hydroxyethyl cellulose salt is preferable, and a sodium or ammonium salt of carboxymethyl cellulose is more preferable. These polysaccharides can form a preferred surface shape of the hydrophilic layer.

The surface of the hydrophilic layer preferably has a convexoconcave structure having a pitch of from 0.1 to 50 μm such as the grained aluminum surface of an aluminum PS plate. The water retention ability and the image maintaining ability are raised by such a convexoconcave structure of the surface. Such a convexoconcave structure can also be formed by adding in an appropriate amount a filler having a suitable particle size to the coating liquid of the hydrophilic layer. However, the convexoconcave structure is preferably formed by coating a coating liquid for the hydrophilic layer containing the alkaline colloidal silica and the water-soluble polysaccharide so that the phase separation occurs at the time of drying the coated liquid, whereby a structure is obtained which provides a good printing performance.

The shape of the convexoconcave structure such as the pitch and the surface roughness thereof can be suitably controlled by the kinds and the adding amount of the alkaline colloidal silica particles, the kinds and the adding amount of the water-soluble polysaccharide, the kinds and the adding amount of another additive, a solid concentration of the coating liquid, a wet layer thickness or a drying condition.

In the invention, it is preferred that the water soluble resin contained in the hydrophilic matrix phase is water soluble, and at least a part of the resin exists in the hydrophilic layer in a state capable of being dissolved in water. If a water soluble carbon atom-containing material is cross-linked by a crosslinking agent and is insoluble in water, its hydrophilicity is lowered, resulting in problem of lowering printing performance. A cationic resin may also be contained in the hydrophilic layer. Examples of the cationic resin include a polyalkylene-polyamine such as a polyethyleneamine or polypropylenepolyamine or its derivative, an acryl resin having a tertiary amino group or a quaternary ammonium group and diacrylamine. The cationic resin may be added in a form of fine particles. Examples of such particles include the cationic microgel described in Japanese Patent O.P.I. Publication No. 6-161101.

A water-soluble surfactant may be added for improving the coating ability of the coating liquid for the hydrophilic layer in the invention. A silicon atom-containing surfactant and a fluorine atom-containing surfactant are preferably used. The silicon atom-containing surfactant is especially preferred in that it minimizes printing contamination. The content of the surfactant is preferably from 0.01 to 3% by weight, and more preferably from 0.03 to 1% by weight based on the total weight of the hydrophilic layer (or the solid content of the coating liquid).

The hydrophilic layer in the invention can contain a phosphate. Since a coating liquid for the hydrophilic layer is preferably alkaline, the phosphate to be added to the hydrophilic layer is preferably sodium phosphate or sodium monohydrogen phosphate. The addition of the phosphate provides improved reproduction of dots at shadow portions. The content of the phosphate is preferably from 0.1 to 5% by weight, and more preferably from 0.5 to 2% by weight in terms of amount excluding hydrated water.

The hydrophilic layer in the invention can contain a light heat conversion material as described later. When the material is in the particle form, the particle size is preferably less than 1 μm.

<Inorganic Particles or Inorganic Material Coated Particles Both Having a Particle Size Not Less than 1 μm>

Examples of the inorganic particles include well-known metal oxide particles include particles of silica, alumina, titania and zirconia. Porous metal oxide particles are preferably used in order to prevent sedimentation of the particles in a coating liquid. Examples of the porous metal oxide particles include the porous silica particles and the porous aluminosilicate particles described above.

The inorganic material coated particles include particles in which organic particles such as polymethyl methacrylate particles or polystyrene particles form cores and the cores are covered with inorganic particles having a size smaller than that of the cores. The particle size of the inorganic particles is preferably from 1/10 to 1/100 of that of the cores. Further, well-known metal oxide particles include particles of silica, alumina, titania and zirconia can be used as the inorganic particles. There are various covering methods, but a dry covering method is preferred in which the cores collide with the covering materials at high speed in air as in a hybridizer for the covering materials to penetrate the surface of the cores and fix them there.

Particles in which organic particles are plated with a metal can be used. Examples of such particles include Micropearl AU produced by Sekisui Kagaku Co., Ltd., in which resin particles are plated with a metal.

It is necessary that the particles have a particle size of not less than 1 μm, and satisfy inequality (1) described previously. The particle size is more preferably from 1 to 10 μm, still more preferably from 1.5 to 8 μm, and most preferably from 2 to 6 μm.

When the particle size exceeds 10 μm, it may lower dissolution of formed images or result in contamination of blanket during printing. In the invention, the content of the particles having a particle size of not less than 1 μm in the hydrophilic layer is suitably adjusted to satisfy the parameters regarding the invention, but is preferably from 1 to 50% by weight, and more preferably from 5 to 40% by weight, based on the hydrophilic layer. The content of materials containing a carbon atom such as the organic resins or carbon black in the hydrophilic layer is preferably lower in increasing hydrophilicity of the hydrophilic layer. The total content of these materials in the hydrophilic layer is preferably less than 9% by weight, and more preferably less than 5% by weight.

[Hydrophilic Overcoat Layer]

In the invention, a hydrophilic overcoat layer is preferably provided on the image formation layer, in order to prevent flaws from occurring during handling. The hydrophilic overcoat layer may be provided directly or through an intermediate layer on the image formation layer. It is preferred that the hydrophilic overcoat layer can be removed on a printing press.

In the invention, it is preferred that the hydrophilic overcoat layer contains a water soluble resin or a water swellable resin in which a water soluble resin is partly cross-linked. The water soluble resin is the same as those used in the image formation layer. In the invention, the hydrophilic overcoat layer can contains a light-to-heat conversion material described later.

The overcoat layer in the invention preferably contains a matting agent with an average size of from 1 to 20 μm, in order to prevent flaws from occurring while the printing plate material is mounted on a laser apparatus or on a printing press.

The matting agent is preferably inorganic particles having a new Mohs hardness of not less than 5 or an organic matting agent. Examples of the inorganic particles having a new Mohs hardness of not less than 5 include particles of metal oxides (for example, silica, alumina, titania, zirconia, iron oxides, chromium oxide), particles of metal carbides (for example, silicon carbide), boron nitride particles, and diamond particles. Examples of the organic matting agent include starch described in U.S. Pat. No. 2,322,037, starch derivatives described in BE 625,451 and GB 981,198, Polyvinyl alcohol described in JP-B-44-3643, polystyrene or polymethacrylate described in CH 330,158, polyacrylonitrile described in U.S. Pat. No. 3,079,257, and polycarbonate described in U.S. Pat. No. 3,022,169.

The adding amount of the matting agent in the overcoat layer is preferably from 0.1 g to less than 10 g per $m^2$.

A coating solution for the overcoat layer may contain a nonionic surfactant in order to secure uniform coatability of the overcoat layer. Examples of the nonionic surfactant include sorbitan tristearate, sorbitan monopalmitate, sorbitan trioleate, stearic acid monoglyceride, polyoxyethylenenonylphenyl ether, and polyoxyethylenedodecyl ether. The content of the nonionic surfactant is preferably 0.05 to 5% by weight, and more preferably 1 to 3% by weight based on the total solid content of the overcoat layer.

In the invention, the dry thickness of the overcoat layer is preferably 0.05 to 1.5 $g/m^2$, and more preferably 0.1 to 0.7 $g/m^2$. This content range prevents occurrence of staining or scratches or deposition of fingerprints, and minimizes ablation scum without impairing removability of the overcoat layer.

[Light-to-Heat Conversion Material]

The image formation layer, hydrophilic layer, hydrophilic overcoat layer or another layer in the invention can contain a light heat conversion material.

Examples of the light heat conversion material include the following substances:

(Infrared Absorbing Dye)

Examples of the light-heat conversion material include a general infrared absorbing dye such as a cyanine dye, a chloconium dye, a polymethine dye, an azulenium dye, a squalenium dye, a thiopyrylium dye, a naphthoquinone dye or an anthraquinone dye, and an organometallic complex such as a phthalocyanine compound, a naphthalocyanine compound, an azo compound, a thioamide compound, a dithiol compound or an indoaniline compound. Exemplarily, the light-heat conversion materials include compounds disclosed in Japanese Patent O.P.I. Publication Nos. 63-139191, 64-33547, 1-160683, 1-280750, 1-293342, 2-2074, 3-26593, 3-30991, 3-34891, 3-36093, 3-36094, 3-36095, 3-42281, 3-97589 and 3-103476. These compounds may be used singly or in combination.

Examples of pigment include carbon, graphite, a metal and a metal oxide. Furnace black and acetylene black is preferably used as the carbon. The graininess ($d_{50}$) thereof is preferably not more than 100 nm, and more preferably not more than 50 nm.

The graphite is one having a particle size of preferably not more than 0.5 μm, more preferably not more than 100 nm, and most preferably not more than 50 nm.

As the metal, any metal can be used as long as the metal is in a form of fine particles having preferably a particle size of not more than 0.5 μm, more preferably not more than 100 nm, and most preferably not more than 50 nm. The metal may have any shape such as spherical, flaky and needle-like. Colloidal metal particles such as those of silver or gold are particularly preferred.

As the metal oxide, materials having black color in the visible regions, or electro-conductive materials or semiconductive materials can be used. Examples of the materials having black color in the visible regions include black iron oxide ($Fe_3O_4$), and black complex metal oxides containing at least two metals. Black complex metal oxides comprised of at least two metals are preferred. Typically, the black complex metal oxides include complex metal oxides comprising at least two selected from Al, Ti, Cr, Mn, Fe, Co, Ni, Cu, Zn, Sb, and Ba. These can be prepared according to the methods disclosed in Japanese Patent O.P.I. Publication Nos. 9-27393, 9-25126, 9-237570, 9-241529 and 10-231441. The complex metal oxide used in the invention is preferably a complex Cu—Cr—Mn type metal oxide or a Cu-Fe-Mn type metal oxide. The Cu—Cr—Mn type metal oxides are preferably subjected to the treatment disclosed in Japanese Patent O.P.I. Publication Nos. 8-27393 in order to reduce isolation of a 6-valent chromium ion. These complex metal oxides have a high color density and a high light heat conversion efficiency as compared with another metal oxide. The primary average particle size of these complex metal oxides is preferably from 0.001 to 1.0 μm, and more preferably from 0.01 to 0.5 μm. The primary average particle size of from 0.001 to 1.0 μm improves a light heat conversion efficiency relative to the addition amount of the particles, and the primary average particle size of from 0.05 to 0.5 μm further improves a light heat conversion efficiency relative to the addition amount of the particles. The light heat conversion efficiency relative to the addition amount of the particles depends on a dispersity of the particles, and the well-dispersed particles have a high light heat conversion efficiency. Accordingly, these complex metal oxide particles are preferably dispersed according to a known dispersing method, separately to a dispersion liquid (paste), before being added to a coating liquid for the particle containing layer. The metal oxides having a primary average particle size of less than 0.001 are not preferred since they are difficult to disperse. A dispersant is optionally used for dispersion. The addition amount of the dispersant is preferably from 0.01 to 5% by weight, and more preferably from 0.1 to 2% by weight, based on the weight of the complex metal oxide particles. Kinds of the dispersant are not specifically limited, but the dispersant is preferably a silicon-contained surfactant.

Examples of the electro-conductive materials or semi-conductive materials include Sb-doped $SnO_2$ (ATO), Sn-added $In_2O_3$ (ITO), $TiO_2$, TiO prepared by reducing $TiO_2$ (titanium oxide nitride, generally titanium black). Particles prepared by covering a core material such as $BaSO_4$, $TiO_2$, $9Al_2O_3.2B_2O$ and $K_2O.nTiO_2$ with these metal oxides is usable. The particle size of these particles is preferably not more than 0.5 μm, more preferably not more than 100 nm, and most preferably not more than 50 nm.

The especially preferred light heat conversion materials are the above-described infrared absorbing dyes or the black complex metal oxides comprised of at least two metal oxides.

The addition amount of the light heat conversion materials is preferably 0.1 to 50% by weight, more preferably 1 to 30% by weight, and most preferably 3 to 25% by weight based on the weight of the layer to which the material are added.

[Visibility]

Before a printing plate with an image is mounted on a printing press for printing, there is usually a plate inspection process for examining if the image is correctly formed on the printing plate. When the plate inspection process is carried out, it is preferred that a printing plate before printing has a property in which an image formed on the printing plate is visible, that is, image visibility. Since the printing plate material of the invention is a processless printing plate material capable of carrying out printing without special development, it is preferred that the optical density of exposed portions in the printing plate material varies by light or heat generated on exposure.

As a method for providing image visibility to a printing plate material in the invention, there is a method employing a cyanine type infrared light absorbing dye, which varies its optical density on exposure, a method employing a combination of a photo-induced acid generating agent and a compound varying its color by an acid, or a method employing a combination of a color forming agent such as a leuco dye and a color developing agent.

In the invention, a photo-induced acid generating agent is a compound producing a Lewis acid or a Broensted acid on light exposure. Examples thereof include a diazonium compound, an orthoquinonediazide compound, a polyhalogenated compound, an onium salt, and a polymer having a unit derived from them.

Examples of the diazonium compound include a condensation product of a diphenylamine-p-diazonium salt and formaldehyde, which is a reaction product of a diazonium compound disclosed in U.S. Pat. Nos. 2,063,631 and 2,667,415 with a reactive carbonyl group-containing compound such as aldol or acetal, a salt of the diazonium salt having as an anion a halogen-containing Lewis acid anion such as $BF_4^-$ or $PF_6^-$, and an aryldiazonium salt.

Examples of the orthoquinonediazide compound include a compound having at least one quinonediazide group in one molecule such as 1,2-naphthoquinone-2-diazide-5-sulfonic acid ethyl ester, 1,2-naphthoquinone-2-diazide-5-sulfonic acid isobutyl ester, 1,2-naphthoquinone-2-diazide-5-sulfonic acid phenyl ester, 1,2-naphthoquinone-2-diazide-5-sulfonic acid α-naphthyl ester, 1,2-naphthoquinone-2-diazide-5-sulfonic acid benzyl ester, 1,2-naphthoquinone-2-diazide-4-sulfonic acid phenyl ester, N-ethyl-1,2-naphthoquinone-2-diazide-4-sulfonic acid amide, and N-phenyl-1,2-naphthoquinone-2-diazide-4-sulfonic acid amide.

Examples of the polyhalogenated compound include an acetophenone containing plural halogens such as tribromoacetophenone, trichloroacetophenone, o-nitro-tribromoacetophenone, p-nitro-tribromoacetophenone, m-nitro-tribromoacetophenone, m-bromo-tribromoacetophenone, or p-bromo-tribromoacetophenone, a sulfoxide containing plural halogens such as bis(trimromomethyl)sulfone, trichloromethylphenylsulfone, tribromomethylphenylsulfone, trichloromethyl-p-chlorophenylsulfone, tribromomethyl-p-nitrophenylsulfone, 2-trichloromethylbenzothiazolesulfone, or 2,4-dichlorophenyl-trichloromethylsulfone, and a pyrone compound, a triazine compound or an oxazole compound each containing plural halogens.

Examples of the onium salt or other photo-induced acid generating compound include an onium salt described in S. P. Papas et al., Polymn. Photochem., 5, 1, p. 104–115 (1984), a photo-induced acid generating agent represented by a diaryliodonium salt such as $Ph_2I^+/SbF_6^-$ described in "Shikizai", 66 (2), p. 104–115 (1994), a triarylsulfonium salt, a triarylselenonium salt, a dialkylphenacylsulfonium salt, a dialkyl-4-phenacylsulfonium salt, an α-hydroxymethylbenzoine sulfonic acid ester, an N-hydroxyiminosulfonate, an α-sufonyloxyketone, a β-sufonyloxyketone, an iron-arene complex (for example, benzene-cyclopentadienyl-iron (II)-hexafluorophosphate), an o-nitrobenzyl silyl ether compound, benzoine tosylate, and tri(nitrobenzyl)phosphate.

Besides the above compounds, there are ammonium salts, phosphonium salts, iodonium salts, sulfonium salts, selenium salts, arsonium salts, organic halides, o-nitrobenzyl derivatives, iminosulfonates and disulfone compounds.

Typical examples thereof include compounds represented by T-1 through T-15 described in Japanese Patent O.P.I. Publication No. 9-244226.

Among these, s-triazine compounds having two or more trihalogenomethyl groups are preferred and tris(trichloromethyl)-s-triazine is especially preferred. The content of the photo-induced acid generating agent is from 0.01 to 40% by weight, and preferably from 0.1 to 30% by weight, based on the total solid component of layers.

In the invention, examples of the compound changing its color by the action of an acid include dyes such as diphenylmethane dyes, triphenylmethane type thiazine dyes, thiazine dyes, oxazine dyes, xanthene dyes, anthraquinone dyes, iminonaphthoquinone dyes, azo dyes, and azomethine dyes.

Typical examples thereof include Briliant green, Ethyl violet, Methyl green, Crystal violet, Basic fuchsine, Methyl violet 2B, Quinardine red, Rose bengale, Metanil yellow, Thymolsulfophthalein, Xylenol blue, Methyl orange, Paramethyl red, Congo red, Benzopurpurin 4B, α-Naphthyl red, Nile blue 2B, Nile blue A, Methyl violet, Marachite green, Para-fuchsine, Victoria pure blue BOH (product of Hodogaya Kagaku), Oil blue #603 (product of Orient Kagaku kogyo), Oil pink #312 (product of Orient Kagaku kogyo), Oil red 5B(product of Orient Kagaku kogyo), Oil scarlet #308 (product of Orient Kagaku kogyo), Oil red OG (product of Orient kagaku kogyo), Oil red RR (product of Orient kagaku kogyo), Oil green #502 (product of Orient kagaku kogyo), Spiron red BEH special (product of Hodogaya Kagaku), m-Cresol purple, Cresol red, Rhodamine B, Rhodamine 6G, Sulforhodamine B, Auramine, 4-p-diethylaminophenyliminonaphthoquinone, 2-carboxyanilino-4-p-diethylaminophenyliminonaphthoquinone, 2-carbostearylamino- 4-p-dihydroxyethylamino-phenyliminonaphthoquinone, 1-phenyl-3-methyl-4-p-diethylaminophenylimino-5-pyrazolone and 1-β-naphthyl-4-p-diethylaminophenylimino-5-pyrazolone.

As the compound changing its color by the action of an acid, organic dyes such as aryl amines can be used. The aryl amines include leuco dyes as well as amines such as a primary aromatic amine and a secondary aromatic amine.

Examples thereof include diphenylamine, dibenzylaniline, triphenylamine, diethylaniline, diphenyl-p-phenylenediamine, p-toluidine, 4,4'-biphenyldiamine, o-chloroaniline, o-bromoaniline, 4-chloro-o-phenylenediamine, o-brom-N,N-dimethylaniline, 1,2,3-triphenylguanidine, naphthylamine, diaminodiphenylmethane, aniline, 2,5-dichloroaniline, N-methyldiphenylamine, o-toluidine, p,p'-tetramethyldiaminodiphenylmethane, N,N-dimethyl-p-phenylenediamine, 1,2-dianilinoethylene, p,p',p"-hexamethyltriaminotriphenylmethane, p,p'-tetramethyldiamino-triphenylmethane, p,p'-tetramethyldiaminodiphenylmethylimine, p,p',p"-triamino-o-methyltriphenylmethane, p,p',p"-triaminotriphenylcarbinol, p,p'-tetramethylaminodiphenyl-4-anilinonaphthylmethane, p,p',p"-triaminotriphenylmethane, and p,p',p"-hexapropyltriaminotriphenylmethane.

In the invention, an acidic substance used as an electron accepter in a thermal recording paper can be used as a color developing agent. Examples thereof include inorganic acids such as acidic china clay kaolin and zeolite, aromatic acids or anhydrides or metal salts thereof, and organic color developing agents such as organic sulfonic acids, other organic acids, phenol compounds, methylol derivatives of the phenol compounds, and salts or complexes of the phenol compounds. Among these, methylol derivatives of the phenol compounds, and salts of the phenol compounds (including complexes) are preferred.

Examples of the organic color developing agents include phenol compounds such as phenol, 4-phenylphenol, 4-hydroxyacetophenone, 2,2'-dihydroxydiphenyl, 2,2'-methylenebis(4-chlorophenol), 2,2'-methylenebis(4-methyl-6-t-butylphenol), 4,4'-isopropylidenediphenol (bisphenol A), 4,4'-isopropylidenebis(2-chlorophenol), 4,4'-isopropylidenebis (2-methylphenol), 4,4'-ethylenebis(2-methylphenol), 4,4'-thiobis(6-t-butyl-3-methylphenol), 1,1-bis(4-hydroxyphenyl)cyclohexanone, 2,2'-bis(4-hydroxyphenyl)-n-heptane, 4,4'-cyclohexylidenebis(2-isopropylphenol), and 4,4'-sulfonyldiphenyl, methylol derivatives of the phenol compounds, salts of the phenol compounds, salicylic acid anilide, novolak resins, benzyl p-hydroxybenzoate.

As the color forming agent used together with the color developing agent in the invention, there is a triphenylmethanelactone type leuco dye.

Examples of such a leuco dye include crystal violet lactone, 3-diethylamino-7-chlorofluoran, 3-diethylamino-6-methyl-7-chlorofluoran, 2-(N-phenyl-N-methylamino)-6-(N-p-Tolyl-N-ethyl)aminofluoran, malachite green lactone, 3,3-bis(1-ethyl-2-methylol-3-yl)phthalide, 3-diethylamino-6-methyl-7-anilinofluoran, 2-anilino-3-methyl-6-(N-ethyl-p-toluidino)fluoran, 3-(N-cyclohexyl-N-methylamino)-6-methyl-7-anilinofluoran, and 3-piperidino-6-methyl-7-anilinofluoran. Further, tris(4-dimethylaminophenyl) methane can be preferably used.

The content ratio by weight, color developing agent/color forming agent is preferably from 0.1/1 to 5/1, and more preferably from 0.5/1 to 3/1.

[Packaging Material]

The printing plate material manufactured above was cut into an intended size, packed in a packaging material and stored till the material is subjected to exposure for image formation as described later. In order to endure a long term storage, the packaging material is preferably one having an oxygen permeability of not more than 50 ml/atm·$m^2$·30° C.·day as disclosed in Japanese Patent O.P.I. Publication No. 2000-206653. As another embodiment, the packaging material is also preferred which has a moisture permeability of not more than 10 g/atm·$m^2$·20° C.·day as disclosed in Japanese Patent O.P.I. Publication No. 2000-206653.

[Exposure]

The present invention forms an image on the printing plate material, employing a laser or a thermal laser, and it is especially preferred in the invention that an image is formed on the printing plate material, employing a thermal laser.

Exposure applied in the invention is preferably scanning exposure, which is carried out employing a laser which can emit light having a wavelength of infrared and/or near-infrared regions, that is, a wavelength of from 700 to 1500 nm. As the laser, a gas laser can be used, but a semi-conductor laser, which emits light having a near-infrared region wavelength, is preferably used.

A device suitable for the scanning exposure in the invention may be any device capable of forming an image on the printing plate material according to image signals from a computer employing a semi-conductor laser.

Generally, the following scanning exposure processes are mentioned.

(1) A process in which a plate precursor provided on a fixed horizontal plate is scanning exposed in two dimensions, employing one or several laser beams.

(2) A process in which the surface of a plate precursor provided along the inner peripheral wall of a fixed cylinder is subjected to scanning exposure in the rotational direction (in the main scanning direction) of the cylinder, employing one or several lasers located inside the cylinder, moving the lasers in the normal direction (in the sub-scanning direction) to the rotational direction of the cylinder.

(3) A process in which the surface of a plate precursor provided along the outer peripheral wall of a fixed cylinder is subjected to scanning exposure in the rotational direction (in the main scanning direction) of the cylinder, employing one or several lasers located inside the cylinder, moving the lasers in the normal direction (in the sub-scanning direction) to the rotational direction of the cylinder.

In the invention, the process (3) above is preferable, and especially preferable when a printing plate material mounted on a plate cylinder of a printing press is scanning exposed.

Employing the thus printing plate material after image recording, printing is carried out without a special development process. After the printing plate material is imagewise exposed and mounted on a plate cylinder of a printing press, or after the printing plate material is mounted on the cylinder and then imagewise heated to obtain a printing plate material, a dampening water supply roller and/or an ink supply roller are brought into contact with the surface of the resulting printing plate material while rotating the plate cylinder to remove non-image portions of the component layer of the printing plate material (so-called, development on press).

The non-image portion removal after image recording as described above in the printing plate material of the invention can be carried out in the same sequences as in conventional PS plates. This means that processing time is shortened due to so-called development on press, resulting in lowering of cost.

It is preferred that the printing method of the invention comprises a step of drying a printing plate material, between the image recording (formation) step and a step of contacting a dampening water supply roller and/or an ink supply roller with the surface of the printing plate material. In the printing method of the invention, it is considered that the image strength gradually increases immediately after the image recording. As the conventional image recording method employing a conventional external thermal laser drum method (the process (3) above) requires about 3 minute exposure time, it has problem in that there is a difference in image strength between an image recorded at the beginning of the exposure and an image recorded at the completion of the exposure. The drying step described above can minimize such an image strength difference.

EXAMPLES

The present invention will be detailed employing the following examples, but the invention is not limited thereto. In the examples, "%" represents % by weight, unless otherwise specified.

Example 1

<<Preparation of Polyethylene Terephthalate Sheet Support>>

Employing terephthalic acid and ethylene glycol, polyethylene terephthalate having an intrinsic viscosity VI of 0.66 (at 25° C. in a phenol/tetrachloroethane (6/4 by weight) solvent) was prepared according to a conventional method. The resulting polyethylene terephthalate was formed into pellets, dried at 130° C. for 4 hours, and melted at 300° C. The melted polyethylene terephthalate was extruded from a T-shaped die onto a 50° C. drum, and rapidly cooled to obtain an unstretched sheet. The resulting sheet was stretched in the mechanical direction at 102° C. by a stretching magnification of 1.3, and then at 110° C. by a stretching magnification of 2.6. Successively, the stretched sheet was further stretched at 100° C. by a stretching magnification of 4.5 in the transverse direction in a tenter. The resulting sheet was heat fixed at 240° C. for 20 seconds and relaxed at 240° C. in the transverse direction by 4%. Thereafter, the sheet at the chuck portions in the tenter was cut off, and the both edges in the transverse direction of the sheet were subjected to knurling treatment. The knurled sheet was cooled to 40° C., and wound around an up-take spool at a tension of 47.1 N/m. Thus, a 190 μm thick biaxially stretched polyethylene terephthalate sheet was prepared. The glass transition temperature (Tg) of this sheet was 79° C. The width of the thus obtained polyethylene terephthalate sheet was 2.5 m. The thickness distribution of the sheet was 3%.

<<Preparation of Subbed Support>>

The both surfaces of the support prepared above were subjected to corona discharge treatment at 8 W/m$^2$·minute. Subsequently, the following subbing layer coating solution "a" was coated on one side of the support to give a first subbing layer with a dry thickness of 0.8 μm, and further, the following subbing layer coating solution "b" was coated on the resulting layer to give a second subbing layer with a dry thickness of 0.1 μm, while carrying out corona discharge treatment (at 8 W/m$^2$·minute), each layer being dried at 180° C. for 4 minutes. (The surface of the thus obtained subbing layer was designated as subbing layer surface A.) The following subbing layer coating solution "c-1", "c-2", or "c-3" was coated on the side of the support opposite the first subbing layer to give a third subbing layer with a dry thickness of 0.8 μm, and further, the following subbing layer coating solution "d-1", "d-2", or "d-3" was coated on the resulting layer, respectively, to give a fourth subbing layer with a dry thickness of 1.0 μm, while carrying out corona discharge treatment (at 8 W/m$^2$·minute), each layer being dried at 180° C. for 4 minutes. (The surface of the thus obtained subbing layer was designated as subbing layer surface B.) The subbing layer surfaces A and B were subjected to plasma treatment under conditions described later. Thus, (subbed) supports A, B and C were prepared.

| (Subbing layer coating solution "a") | |
|---|---|
| Latex of styrene/glycidyl methacrylate/butyl acrylate (60/39/1) copolymer (Tg = 75° C.) (in terms of solid content) | 6.3% |
| Latex of styrene/glycidyl methacrylate/butyl acrylate (20/40/40) copolymer (in terms of solid content) | 1.6% |
| Anionic surfactant S-1 | 0.1% |
| Water | 92.0% |

| (Subbing layer coating solution "b") | |
|---|---|
| Gelatin | 1% |
| Anionic surfactant S-1 | 0.05% |
| Hardener H-1 | 0.02% |
| Matting agent (Silica particles with an average particle size of 3.5 μm) | 0.02% |
| Antifungal agent F-1 | 0.01% |
| Water | 98.9% |

S-1

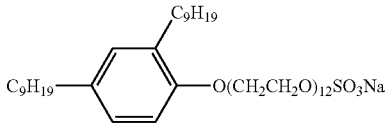

H-1

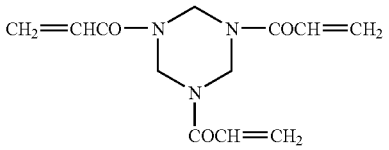

F-1

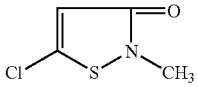

(Component A)

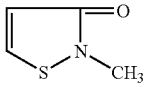

(Component B)

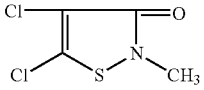

(Component C)

(Component A):(Component B):(Component C) = 50:46:4 (by mole)

| (Subbing layer coating solution "c-1") | |
|---|---|
| Latex of styrene/glycidyl methacrylate/butyl acrylate (20/40/40) copolymer (in terms of solid content) | 0.4% |
| Latex of styrene/glycidyl methacrylate/butyl acrylate/acetoacetoxyethyl methacrylate (39/40/20/1) copolymer (in terms of solid content) | 7.6% |
| Anionic surfactant S-1 | 0.1% |
| Water | 91.9% |

| (Subbing layer coating solution "d-1") | |
|---|---|
| Conductive composition of * Component d-11/Component d-12/Component d-13 (=66/31/1) | 6.4% |
| Hardener H-2 | 0.7% |
| Anionic surfactant S-1 | 0.07% |
| Matting agent (Silica particles with an average particle size of 3.5 μm) | 0.03% |
| Water | 93.4% |

Component d-11:

Copolymer (Anionic polymer) of styrene sulfonic acid/maleic acid (50/50)

Component d-12:

Latex of styrene/glycidyl methacrylate/butyl acrylate (20/40/40) copolymer

Component d-13:

Copolymer (Polymer surfactant) of styrene/sodium isoprene sulfonate (80/20)

H-2

Mixture of three compounds below

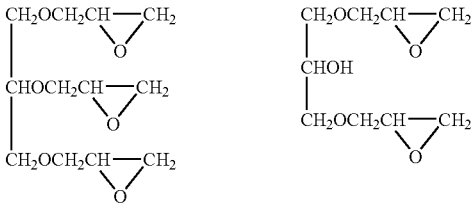

-continued

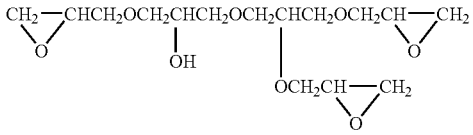

| (Subbing layer coating solution "c-2") | |
|---|---|
| Julimer ET-410 (Tg = 52° C.) (produced by Nippon Junyaku Co., Ltd.) | 21% |
| $SnO_2$/Sb (9/1 by weight) particles (average particle size: 0.25 μm) | 67% |
| Matting agent polymethyl methacrylate (average particle size: 5 μm) | 4% |
| Denacol EX-614B (produced by Nagase Kasei Kogyo Co., Ltd.) | 7% |

| (Subbing layer coating solution "d-2") | |
|---|---|
| PVdC polymer latex (Core-shell type latex containing particles comprised of 90% by weight of core and 10% by weight of shell, the core comprised of a copolymer of vinylidene chloride/methyl acrylate/methyl methacrylate/acrylonitrile/acrylic acid {93/3/3/0.9/0.1 (% by weight)}, and the shell comprised of a copolymer of vinylidene chloride/methyl acrylate/methyl methacrylate/acrylonitrile/acrylic acid {88/3/3/3/3 (% by weight)}, the weight average molecular weight of the copolymer being 38,000) | 3,000 parts by weight |
| 2,4-Dichloro-6-hydroxy-s-triazine | 23 parts by weight |
| Matting agent (polystyrene, average particle size of 2.4 μm) | 1.5 parts by weight |

| (Subbing layer coating solution "c-3") | |
|---|---|
| Latex of styrene/glycidyl methacrylate/butyl acrylate (60/39/1) copolymer (Tg = 75° C.) (in terms of solid content) | 6.2% |
| Latex of styrene/glycidyl methacrylate/butyl acrylate (20/40/40) copolymer (in terms of solid content) | 1.7% |
| Anionic surfactant S-1 | 0.1% |
| Water | 92.0% |

| (Subbing layer coating solution "d-3") | |
|---|---|
| Gelatin | 1% |
| Anionic surfactant S-1 | 0.05% |
| Antifungal agent F-1 | 0.01% |
| Water | 98.9% |

(Plasma Treatment)

The resulting subbed support was subjected to plasma treatment in the presence of a mixed gas of argon/nitrogen/hydrogen (90/5/5% by volume) at a high frequency output power of 4.5 kW and at a frequency of 5 kHz for 5 seconds, employing a batch type atmospheric pressure plasma treatment apparatus AP-I-H340 (produced by Iishii Kagaku Co., Ltd.).

<<Heat Treatment of Subbed Support>>

(Heat Treatment Conditions)

Each subbed support was slit to obtain a width of 1.25 m, and subjected to heat treatment (low tension heat treatment) at a tension of 2 hPa at 180° C. for one minute.

<<Preparation of Printing Plate Material Sample>>

The support having a subbing layer was dried at 100° C. for 30 seconds, and covered with a moisture proof sheet so as not to contact moisture in air to obtain a covered support 2. The moisture content of the support was measured. The moisture content of the support was 0.2%. The printing plate material sample was prepared as follows. The covered support, immediately after uncovered, was coated with a hydrophilic layer.

The backing layer coating solution shown in Table 1 (the preparation method will be described later was coated on the subbing layer surface B of the resulting support with a wire bar to give a dry thickness of 3 g/m$^2$. A coated layer from the backing layer coating solution B-1 was dried at 25° C. for 30 minutes, and a coated layer from the backing layer coating solution B-2 was dried at 50° C. for 3 minutes. The smoother value of the backing layer surface from the backing layer coating solution B-1 was 0.5 kPa, and the smoother value of the backing layer surface from the backing layer coating solution B-2 was 65 kPa.

The hydrophilic layer 1 coating solution shown in Table 2 (the preparation method will be described later), and the hydrophilic layer 2 coating solution shown in Table 3 (the preparation method will be described later) were coated in that order on the subbing layer A of the resulting support with a wire bar to give a dry thickness of 2.5 g/m$^2$ and 0.6 g/m$^2$, respectively, dried at 120° C. for 3 minutes, and further heat treated at 60° C. for 24 hours. Thereafter, the image formation layer shown in Table 4 was coated with a wire bar on the resulting hydrophilic layer to give a dry thickness of 0.6 g/m$^2$, dried at 50° C. for 3 minutes, and further subjected to seasoning treatment at 50° C. for 72 hours. Thus, a printing plate material sample was prepared.

[Preparation of Backing Layer Coating Solution]

The materials as shown in Table 1 were sufficiently mixed in the amounts shown in Table 1 while stirring, employing a homogenizer, and filtered, diluted with pure water, and dispersed to obtain a backing layer coating solution. In Table 1, numerical values represent parts by weight in terms of solid content.

TABLE 1

| Materials | B-1 | B-2 |
|---|---|---|
| Colloidal silica (alkali type): Snowtex XS (solid 20% by weight, produced by Nissan Kagaku Co., Ltd.) | 17 | 49 |
| Porous metal oxide particles Silton JC 50 (porous aluminosilicate particles having an average particle size of 5 μm, produced by Mizusawa Kagaku Co., Ltd.) | — | 25 |
| Aqueous black pigment dispersion SD9020 (carbon black particles with an average particle size of 0.15 μm, produced by Dainippon Ink Co., Ltd.) | 3 | 3 |
| Aqueous 10% by weight polyvinyl alcohol PVA117 solution, produced by Kuraray Co., Ltd.) | 40 | 10 |
| Acryl emulsion AE986A (solid content of 35% by weight, Produced by JSR Co., Ltd.) | 40 | 15 |

[Preparation of Hydrophilic Layer 1 Coating Solution]

The materials as shown in Table 2 were sufficiently mixed in the amounts shown in Table 2 while stirring, employing a homogenizer, filtered, diluted with pure water, and dispersed to obtain hydrophilic layer 1 coating solution. In Table 2, numerical values represent parts by weight in terms of solid content.

TABLE 2

| Materials | Amount |
|---|---|
| Colloidal silica (alkali type): Snowtex XS (solid 20% by weight, produced by Nissan Kagaku Co., Ltd.) | 46.9 |
| Colloidal silica (alkali type): Snowtex ZL (solid 40% by weight, produced by Nissan Kagaku Co., Ltd.) | 3 |
| STM-6500S produced by Nissan Kagaku Co., Ltd. (spherical particles comprised of melamine resin as cores and silica as shells with an average particle size of 6.5 μm and having a convexo-concave surface) | 15 |
| Cu-Fe-Mn type metal oxide black pigment: TM-3550 black aqueous dispersion {prepared by dispersing TM-3550 black powder having a particle size of 0.1 μm produced by Dainichi Seika Kogyo Co., Ltd. in water to give a solid content of 40% by weight (including 0.2% by weight of dispersant)} | 20 |
| Layer structural clay mineral particles: Montmorillonite Mineral Colloid MO gel prepared by vigorously stirring montmorillonite Mineral Colloid MO; gel produced by Southern Clay Products Co., Ltd. (average particle size: 0.1 μm) in water in a homogenizer to give a solid content of 5% by weight | 1.1 |
| Aqueous 4% by weight sodium carboxymethyl cellulose solution (Reagent produced by Kanto Kagaku Co., Ltd.) | 0.6 |
| Aqueous 10% by weight sodium phosphate.dodecahydrate solution (Reagent produced by Kanto Kagaku Co., Ltd.) | 0.3 |
| Porous metal oxide particles Silton JC 40 (porous aluminosilicate particles having an average particle size of 4 μm, produced by Mizusawa Kagaku Co., Ltd.) | 11.1 |

[Preparation of Hydrophilic Layer 2 Coating Solution]

The materials as shown in Table 3 were sufficiently mixed in the amounts shown in Table 3 while stirring, employing a homogenizer, filtered, diluted with pure water, and dispersed to obtain hydrophilic layer 2 coating solution. In table 3, numerical values represent parts by weight in terms of solid content.

TABLE 3

| Materials | Amount |
|---|---|
| Colloidal silica (alkali type): Snowtex S (solid 30% by weight, produced by Nissan Kagaku Co., Ltd.) | 13 |
| Necklace colloidal silica (alkali type): Snowtex-PSM (solid 20% by weight, produced by Nissan Kagaku Co., Ltd.) | 19.5 |
| Colloidal silica (alkali type): MP-4540 ((average particle size: 0.4 μm, solid 30% by weight, produced by Nissan Kagaku Co., Ltd.) | 15 |
| Cu-Fe-Mn type metal oxide black pigment: TM-3550 black aqueous dispersion {prepared by dispersing TM-3550 black powder having a particle size of 0.1 μm produced by Dainichi Seika Kogyo Co., Ltd. in water to give a solid content of 40% by weight (including 0.2% by weight of dispersant)} | 9 |
| Layer structural clay mineral particles: Montmorillonite Mineral Colloid MO gel prepared by vigorously stirring montmorillonite Mineral Colloid MO; gel produced by Southern Clay Products Co., Ltd. (average particle size: 0.1 μm) in water in a homogenizer to give a solid content of 5% by weight | 2 |
| Aqueous 4% by weight sodium carboxymethyl cellulose solution (Reagent produced by Kanto Kagaku Co., Ltd.) | 1 |
| Aqueous 10% by weight sodium phosphate.dodecahydrate solution (Reagent produced by Kanto Kagaku Co., Ltd.) | 0.5 |

TABLE 3-continued

| Materials | Amount |
|---|---|
| Porous metal oxide particles Silton AMT08 (porous aluminosilicate particles having an average particle size of 0.6 μm, produced by Mizusawa Kagaku Co., Ltd.) | 30 |
| Porous metal oxide particles Silton JC 20 (porous aluminosilicate particles having an average particle size of 2 μm, produced by Mizusawa Kagaku Co., Ltd.) | 10 |

[Preparation of Image Formation Layer Coating Solution]

The materials for the image formation layer coating solution are shown in Table 4. The materials as shown in Table 4 were sufficiently mixed in the amounts shown in Table 4 while stirring, employing a homogenizer, filtered, diluted with pure water, and dispersed to obtain an image formation layer coating solution. In Table 4, numerical values represent parts by weight in terms of solid content.

TABLE 4

| Materials | Amount |
|---|---|
| Dispersion prepared by diluting with pure water carnauba wax emulsion A118 (having a solid content of 40% by weight, the wax having an average particle size of 0.3 μm, a melting viscosity at 140° C. of 8 cps, a softening point of 65° C., and a melting point of 80° C., produced by GifuCerac Co., Ltd.) to give a solid content of 5% by weight | 66.5 |
| Microcrystalline wax emulsion A206 (having a solid content of 40% by weight, the wax having an average particle size of 0.3 μm, a softening point of 65° C., a melting point of 80° C., and a melting viscosity at 140° C. of 8 cps, produced by GifuCerac Co., Ltd.) | 25 |
| Aqueous 5% by weight solution of disaccharide trehalose powder (Trehaose, mp. 97° C., produced by Hayashihara Shoji Co., Ltd.) | 25 |
| Infrared dye | 0.5 |
| Aqueous solution of sodium polyacrylate (water-solble resin, average molecular weight: 170,000) AQUALIC DL522 (solid content 30.5%), produced by Nippon Shokubai Co., Ltd. | 7.5 |

Infrared Dye

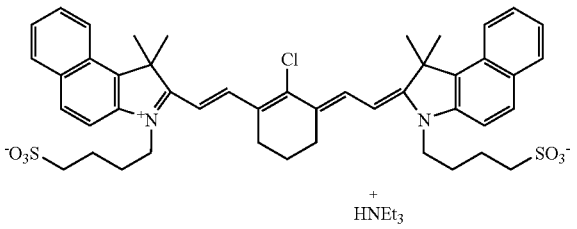

<<Preparation of Printing Plate Sample>>

The resulting printing plate material was cut into a size of 73 cm (width)×32 m (length), and wound around a spool made of cardboard having a diameter of 7.5 cm. Thus, a printing plate sample in roll form was prepared. The resulting printing plate sample was wrapped in a 150 cm×2 m package made of $Al_2O_3$PET (12 μm)/Ny (15 μm)/CPP (70 μm). The resulting wrapped material was stored at 60° C. and 60% RH for seven days. The package had an oxygen permeation of 1.7 ml/atm·m$^2$·30° C.·day, and a moisture permeability of 1.8 g/atm·m$^2$·25° C.·day.

<<Preparation of Underlay Sheet Sample U-1>>

Polyvinyl alcohol PVA 405 (produced by Kuraray Co., Ltd.) of 5 g was added to 50 g of water with stirring, and further stirred for 30 minutes. The resulting solution was added with 3 g of tetramethoxysilane (produced by Shinetsu kagaku Co., Ltd.), stirred for 30 minutes, then added with 1 ml of a concentrated hydrochloric acid solution, then stirred for 2 hours. The resulting solution was further added with glass particles GB731 with an average particle size of 20 μm (produced by Tosiba Garasu Co., Ltd.) to give a layer with a thickness of 0.08 g/m$^2$, dispersed for 15 minutes in the presence of glass beads in a paint shaker (produced by Toyo Seiki Co., ltd.), and filtered to obtain a dispersion. The resulting dispersion was coated on a surface of a 100 μm thick polyethylene terephthalate sheet with a wire bar to give a thickness of 4 g/m$^2$, and dried at 110° C. for 3 minutes. Thus, underlay sheet sample U-1 was obtained. The smoother value of the underlay sheet sample U-1 was 95 kPa.

<<Preparation of Underlay Sheet Sample U-2>>

Underlay sheet sample U-2 was prepared in the same manner as in underlay sheet sample U-1, except that polymethyl methacrylate particles with an average particle size of 2 μm were used as a matting agent instead of glass particles GB731. The smoother value of the underlay sheet sample U-2 was 2 kPa.

<<Preparation of Underlay Sheet Sample U-3>>

Underlay sheet sample U-3 was prepared in the same manner as in underlay sheet sample U-1, except that silicon dioxide particles with an average particle size of 0.9 μm were used as a matting agent instead of glass particles GB731. The smoother value of the underlay sheet sample U-2 was 0.5 kPa.

The coefficient of dynamic friction and specific resistance of the backing layer side surface of the printing plate material sample obtained above were measured according to the following methods.

<<Measurement of Coefficient of Dynamic Friction>>

Measuring Apparatus: DF-PM APPARATUS Produced by Kyowa Kaimen Kagaku Co., Ltd.

Measuring Method:

After each printing plate material sample was stored at 23° C. and 55% RH for 24, the coefficient of dynamic friction was determined at 23° C. and 55% RH. The coefficient of dynamic friction in the invention is one determined according to a method according to JIS K7125.

The backing layer side surface of the sample was brought into contact with the underlay sheet surface at a contact area of 100 mm×100 mm and then load of a 50 g stainless steel piece was fixed on the front surface of the sample. Thereafter, the load was pulled in the horizontal direction by application of force to move at a speed of 100 mm/minute, and the average force (F) was measured. The coefficient (μ) of dynamic friction was defined by the following formula:

$$\text{Coefficient of dynamic friction} = F(g)/\text{Weight } (g) \text{ of load}$$

<<Measurement of Specific Resistance>>

Measuring Meter: Teraohm Meter Model VE-30 Produced by Kawaguchi Denki Co., Ltd.

Measuring method: Immediately after the sample was stored at 23° C. and 20% RH for 24 hours, the specific resistance of the backing layer side surface was determined under the same conditions as above, employing a specific resistance meter.

[Image Formation Employing Infrared Laser]

The resulting printing plate sample was cut so as to suit an exposure device, wound around an exposure drum of the exposure device and imagewise exposed. Exposure was carried out employing an infrared laser (having a wavelength of 830 nm and a laser beam spot diameter of 18 μm) at a resolution of 2400 dpi to form an image with a screen number of 175 lines. In the exposure, the exposure energy on the image formation layer surface was varied from 150 to 350 mJ/cm$^2$ at an interval of 50 mJ/cm$^2$. The term, "dpi" shows the number of dots per 2.54 cm. Thus, an exposed printing plate sample with an image was obtained.

[Evaluation as Printing Plate]

(Printing Method)

Printing was carried out employing a printing press LITHRONE 26P produced by KOMORI CORPORATION. Underlay sheet U-1 or U2 was adhered onto a plate cylinder of the printing press, and the printing plate material sample as shown in Table 5 was provided on the resulting underlay sheet. Then, printing was carried out employing coated paper sheets, dampening water 2% aqueous solution of Astromark 3 (produced by Nikken Kagaku Kenkyusho), and ink (Toyo King Hyecho M Magenta, produced by TOYO INK MANUFACTURING Co.). Printing was started in the same way as in printing sequence in a conventional PS plate, however, no special development was carried out on the press. After printing was completed, non-image portions of the printing plate were eliminated.

(Evaluation of Printing Position Stability)

Two cross-shaped lines with a width of 50 μm one being 50 cm distant from the other, were recorded on the image forming layer of the sample. Thus, three exposed printing plate material samples were obtained per each of the printing plate material samples. After the three exposed samples with the cross-shaped lines were mounted on the three plate cylinders of the printing press, respectively, printing was carried out in the same manner as above, except that three kinds of color ink, Toyo King Hyecho M Yellow, M Indigo, and M Magenta were used for each exposed sample. After 50 copies were printed, no "out of position of the cross-shaped lines" was observed in the fiftieth copy. Thereafter, further 500 copies were printed, and then "out of position of the cross-shaped lines" in the 500$^{th}$ copy was observed employing a magnifying glass, and the distance between two color lines of three color lines farthest (most distant) from each other was measured. The smaller the distance, the more excellent the registering property is.

[Initial Ink Receptivity]

After one thousand copies were printed, printing was carried out by supplying only dampening water for 5 minutes, without supplying ink. After that, printing was restarted supplying both dampening water and ink, and the number of printed matter printed till prints with good image of a normal ink density were obtained was counted. The less the number, the higher the ink receptivity is.

<<Evaluation of Printing Durability>>

Printing was carried out in the same manner as above to obtain 20,000 copies. The number of paper sheets printed from when printing started till when 50% or more of dots of the 3% dot image were eliminated was counted. The more the number, the higher printing durability is. The results are shown in Table 5.

TABLE 5

| Printing plate material sample No. (printing plate sample No.) | Subbing layer coating solution | Backing layer coating solution | Underlay sheet | Co-efficient of dynamic friction | Surface resistance (Ω) | Printing position stability (μm) | Ink recaptivity (number) | Printing durability (number) | Remarks |
|---|---|---|---|---|---|---|---|---|---|
| 101 | c-3/d-3 | B-1 | U-1 | 0.8 | $5 \times 10^{14}$ Ω | 210 | 100 | 5,000 | Comp. |
| 102 | c-3/d-3 | B-2 | U-1 | 0.8 | $5 \times 10^{14}$ Ω | 190 | 60 | 5,000 | Comp. |
| 103 | c-2/d-2 | B-1 | U-1 | 0.8 | $1 \times 10^{11}$ Ω | 195 | 60 | 5,000 | Comp. |
| 104 | c-1/d-1 | B-2 | U-2 | 0.4 | $1 \times 10^{11}$ Ω | 40 | 10 | not less than 20,000 | Inv. |
| 105 | c-2/d-2 | B-2 | U-2 | 0.4 | $1 \times 10^{11}$ Ω | 40 | 10 | not less than 20,000 | Inv. |
| 106 | c-2/d-2 | B-2 | U-3 | 0.2 | $1 \times 10^{11}$ Ω | 35 | 12 | not less than 20,000 | Inv. |

Comp.: Comparative,
Inv.: Inventive

As is apparent from Table 5, the inventive samples provide excellent printing position stability, excellent ink receptivity and excellent printing durability, as compared with comparative samples.

Example 2

A printing plate material sample was prepared in the same manner as in Example 1 of the present Specification, in which backing layer coating solution B-2 was coated on the subbing layer surface B, and hydrophilic layer coating solution 1, hydrophilic layer coating solution 1, and the image formation layer coating solution were coated coated on the subbing layer surface A. Subsequently, the following overcoat layer coating solution was coated on the resulting image formation layer to give a dry thickness of 0.4 g/m$^2$, dried at 50° C. for 3 minutes, and further treated to seasoning treatment at 50° C. for 24 hours. After that, the resulting material was allowed to stand at 23° C. and 20% RH for 24 hours.

| [Overcoat layer coating solution] | |
|---|---|
| Polyvinyl acetate having a degree of saponification of 98% (weight average molecular weight: 200,000) | 15 parts by weight |
| Hexamethylene diisocyanate | 1 part by weight |
| Matting agent (amorphous silica, Average particle size: 2 μm) | 2 parts by weight |
| Water | 82 parts by weight |

<<Preparation of Printing Plate Sample>>

A printing plate material sample in roll form was prepared in the same manner as in Example 1, in which the resulting printing plate material obtained above was cut into a size of 73 cm (width)×32 m (length), and wound around a spool made of cardboard having a diameter of 7.5 cm. The resulting printing plate sample was wrapped in a 150 cm×2 m package made of $Al_2O_3$PET (12 μm)/Ny (15 μm)/CPP (70 μm). The resulting wrapped material was stored at 60° C. and 60% RH for seven days. The package had an oxygen permeation of 1.7 ml/atm·$m^2$·30° C.·day, and a moisture permeability of 1.8 g/atm·$m^2$·25° C.·day.

The sample was exposed in the same manner as in Example 1. Thus, an exposed printing plate sample (sample 204) with an image was obtained. The resulting sample was processed and evaluated in the same manner as in Example 1, except that printing was carried out in the same manner as above to obtain 20,000 copies, and the number of paper sheets printed from when printing started till when unevenness was observed at solid image portions.

The results are shown in Table 6.

TABLE 6

| Printing plate material sample No. | Subbing layer coating solution | Backing layer coating solution | Underlay sheet | Coefficient of dynamic friction | Surface resistance (Ω) | Printing position stability (μm) | Ink recaptivity (number) | Printing durability (number) | Remarks |
|---|---|---|---|---|---|---|---|---|---|
| 204 | c-1/d-1 | B-2 | U-2 | 0.4 | $1 \times 10^{11}$ Ω | 40 | 12 | not less than 20,000 | Inv. |

Inv.: Invention

As is apparent from Table 6, the inventive sample 204 provides excellent printing position stability, excellent ink receptivity and excellent printing durability.

EFFECT OF THE INVENTION

The present invention can provide a printing method employing a printing plate material comprising a plastic sheet support, the method providing improved printing position stability, initial ink receptivity and printing durability.

What is claimed is:

1. A printing method comprising the steps of:

mounting an underlay sheet on a plate cylinder of a printing press; and providing, on the underlay sheet, a printing plate material comprising a plastic sheet support, and provided thereon, a hydrophilic layer, an image formation layer and a backing layer, the backing layer being provided on the side of the support opposite the image formation layer, so that the backing layer side surface of the printing plate material contacts the underlay sheet surface, wherein a coefficient of dynamic friction of the backing layer side surface of the printing plate material to the underlay sheet surface is from 0.1 to 0.5, and wherein a specific resistance at 23° C. and 20% RH of the backing layer side surface of the printing plate material is from $1\times10^{11}$ to $2\times10^{13}$ Ω.

2. The printing method of claim 1, wherein the coefficient of dynamic friction of the backing layer side surface of the printing plate material to the underlay sheet surface is from 0.1 to 0.45.

3. The printing method of claim 1, wherein the plastic sheet support of the printing plate material is a polyester film sheet having an average thickness of from 120 to 300 μm, and having a thickness distribution of not more than 10%.

4. The printing method of claim 1, wherein the image formation layer contains heat melting particles or heat fusible particles.

5. The printing method of claim 1, wherein the underlay sheet comprises a substrate and provided thereon, a surface layer containing particles with an average particle diameter of from 0.1 to 15 μm.

6. The printing method of claim 1, wherein an electrically conductive layer containing an electrically conductive material is provided on the backing layer side of the printing plate material.

7. A printing method comprising the steps of:

mounting an underlay sheet on a plate cylinder of a printing press; and providing, on the underlay sheet, a printing plate material comprising a plastic sheet support, and provided thereon, a hydrophilic layer, an image formation layer and a backing layer, the backing layer being provided on the side of the support opposite the image formation layer, so that the backing layer side surface of the printing plate material contacts the underlay sheet surface, wherein a coefficient of dynamic friction of the backing layer side surface of the printing plate material to the underlay sheet surface is from 0.1 to 0.5, and wherein the backing layer side has a surface with a smoother value of from 5 to 120 kPa and the underlay sheet has a surface with a smoother value of from 0.2 to 20 kPa.

8. The printing method of claim 7, wherein the coefficient of dynamic friction of the backing layer side surface of the printing plate material to the underlay sheet surface is from 0.1 to 0.45.

9. The printing method of claim 7, wherein the plastic sheet support of the printing plate material is a polyester film sheet having an average thickness of from 120 to 300 μm, and having a thickness distribution of not more than 10%.

10. The printing method of claim 7, wherein the image formation layer contains heat melting particles or heat fusible particles.

11. The printing method of claim 7, wherein the underlay sheet comprises a substrate and provided thereon, a surface layer containing particles with an average particle diameter of from 0.1 to 15 μm.

12. The printing method of claim 7, wherein an electrically conductive layer containing an electrically conductive material is provided on the backing layer side of the printing plate material.

* * * * *